US010982814B2

(12) United States Patent
de Oliveira et al.

(10) Patent No.: US 10,982,814 B2
(45) Date of Patent: Apr. 20, 2021

(54) HANDLE ASSEMBLY FOR A PORTABLE PRESSURIZED GAS CYLINDER

(71) Applicant: AMTROL Licensing Inc., West Warwick, RI (US)

(72) Inventors: Tiago Teixeira Rego de Oliveira, Oporto (PT); Carlos Aguiar, Oporto (PT)

(73) Assignee: AMTROL LICENSING INC., West Warwick, RI (US)

( * ) Notice: Subject to any disclaimer, the term of this patent is extended or adjusted under 35 U.S.C. 154(b) by 0 days.

(21) Appl. No.: 16/559,037

(22) Filed: Sep. 3, 2019

(65) Prior Publication Data

US 2021/0062975 A1 Mar. 4, 2021

(51) Int. Cl.

| | |
|---|---|
| ***B65D 25/30*** | (2006.01) |
| ***F17C 13/08*** | (2006.01) |
| *B65D 25/28* | (2006.01) |

(52) U.S. Cl.

CPC ..... *F17C 13/08* (2013.01); *B65D 25/30* (2013.01); *B65D 25/2826* (2013.01);

(Continued)

(58) Field of Classification Search

CPC ..... B25G 3/12; B25G 3/18; F17C 2221/035; F17C 2205/0165; F17C 2205/0308;

(Continued)

(56) References Cited

U.S. PATENT DOCUMENTS

2003/0235463 A1* 12/2003 Neumann ..... B25G 3/18 403/329
2010/0147859 A1* 6/2010 Chohfi ..... F17C 13/123 220/581

(Continued)

FOREIGN PATENT DOCUMENTS

DE 102008057632 A1 * 5/2010 ..... B65D 25/2826
DE 102017007162 A1 1/2019

(Continued)

OTHER PUBLICATIONS

International Search Report and Written Opinion for corresponding PCT Application No. PCT/US2020/032865, dated Aug. 20, 2020, 15 pages.

*Primary Examiner* — Allan D Stevens
(74) *Attorney, Agent, or Firm* — Tucker Ellis LLP; Carlos Garritano

(57) ABSTRACT

Provided is a handle assembly for a cylinder. The handle assembly includes a shroud configured to attach to a collar of the cylinder to surround a valve port of the cylinder, the shroud having a first plurality of circumferentially spaced deflectable fingers extending downward in a first direction, and a second plurality of circumferentially spaced deflectable fingers extending upward in a second direction, and a handle configured to attach to the shroud, the handle having a body configured to surround and abut the shroud, and a first plurality of circumferentially spaced openings extending through the body. The first plurality of circumferentially spaced deflectable fingers are deflectable to engage respec- (Continued)

tive openings in the collar to attach the shroud to the collar, and the second plurality of circumferentially spaced deflectable fingers are deflectable to engage a respective one of the first plurality of circumferentially spaced openings in the handle.

20 Claims, 22 Drawing Sheets

(52) U.S. Cl.
CPC . *F17C 2201/0119* (2013.01); *F17C 2201/058* (2013.01); *F17C 2205/0165* (2013.01); *F17C 2205/0308* (2013.01)

(58) Field of Classification Search
CPC ..... B65D 25/2826; B65D 25/2894; B65D 25/285; B65D 25/2811; B65D 25/2817; B65D 25/282; B65D 25/30
See application file for complete search history.

(56) References Cited

U.S. PATENT DOCUMENTS

| | | | | |
|---|---|---|---|---|
| 2012/0248128 | A1 | 10/2012 | Chohfi et al. | |
| 2013/0277376 | A1* | 10/2013 | Liebenberg | B62B 1/26 220/589 |
| 2014/0217106 | A1* | 8/2014 | Goncalves | F17C 13/00 220/581 |
| 2016/0215928 | A1* | 7/2016 | Chohfi | F17C 1/00 |
| 2019/0134805 | A1* | 5/2019 | Ni | B25G 3/36 |

FOREIGN PATENT DOCUMENTS

| | | | | |
|---|---|---|---|---|
| EP | 1744093 | A2 * | 1/2007 | F17C 1/14 |
| EP | 3193072 | B1 | 12/2017 | |
| FR | 1564018 | A * | 4/1969 | F17C 13/084 |
| FR | 2880404 | A1 * | 7/2006 | F17C 13/06 |
| WO | WO-2020071894 | A1 * | 4/2020 | F17C 13/06 |

* cited by examiner

HANDLE ASSEMBLY FOR A PORTABLE PRESSURIZED GAS CYLINDER

TECHNICAL FIELD

In general, the present invention relates to a portable pressurized gas cylinder, and in particular to a handle assembly for a portable pressurized gas cylinder.

BACKGROUND OF THE INVENTION

A variety of pressurized gas cylinders have been used for storage and transportation of pressurized gas products for household and industrial. For example, the cylinders may be used for the storage of gas for cooking appliances such as stoves or grills. Many of these cylinders have traditionally been fabricated of steel with a steel cylindrical body having a valve at the top for controlling the flow of gas from the cylinder, a footing at the bottom to provide stability for the cylinder upon a supporting surface, and a handle at the top to assist in transporting the cylinder and for protecting the valve.

SUMMARY OF THE INVENTION

In accordance with an embodiment of the present invention, a handle assembly for a cylinder is provided that includes a shroud configured to attach to a collar of the cylinder to surround a valve port of the cylinder, the shroud having a first plurality of circumferentially spaced deflectable fingers extending downward in a first direction, and a second plurality of circumferentially spaced deflectable fingers extending upward in a second direction, and a handle configured to attach to the shroud, the handle having a body configured to surround and abut the shroud, and a first plurality of circumferentially spaced openings extending through the body, wherein the first plurality of circumferentially spaced deflectable fingers are deflectable to engage respective openings in the collar to attach the shroud to the collar, and the second plurality of circumferentially spaced deflectable fingers are deflectable to engage a respective one of the first plurality of circumferentially spaced openings in the handle.

In accordance with another embodiment of the present invention, a portable gas cylinder is provided that includes a gas tank having an upper portion having a valve port and a collar surrounding the valve port, the collar having a plurality of circumferentially spaced openings, and a handle assembly attached to the gas tank. The handle assembly includes a shroud having a plurality of circumferentially spaced body portions, a first plurality of circumferentially spaced deflectable fingers extending downward in a first direction that are each engaged with a respective one of the plurality of circumferentially spaced openings in the collar to attach the shroud to the collar, and a second plurality of circumferentially spaced deflectable fingers extending upward in a second direction, and a handle attached to the shroud, the handle having a body that surrounds and abuts the shroud, and a plurality of circumferentially spaced openings extending through the body, wherein the second plurality of circumferentially spaced deflectable fingers are engaged with a respective one of the plurality of circumferentially spaced openings in the handle.

In accordance with still another embodiment of the present invention, a method of assembling a portable gas cylinder is provided. The gas cylinder includes a handle assembly and a gas tank having an upper portion having a valve port and a collar surrounding the valve port. The method comprises lowering a shroud of the handle assembly onto the mounting collar to cause a first plurality of circumferentially spaced fingers of the shroud to be deflected radially outwardly by the mounting collar until catches of the fingers engage in respective openings in the mounting collar, and lowering a handle of the handle assembly onto the shroud to cause a second plurality of circumferentially spaced fingers of the shroud to be deflected radially outwardly by the handle until catches of the fingers engage in respective openings in the handle.

These and other objects of this invention will be evident when viewed in light of the drawings, detailed description and appended claims.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof, and wherein.

DETAILED DESCRIPTION OF THE INVENTION

Figure 1:
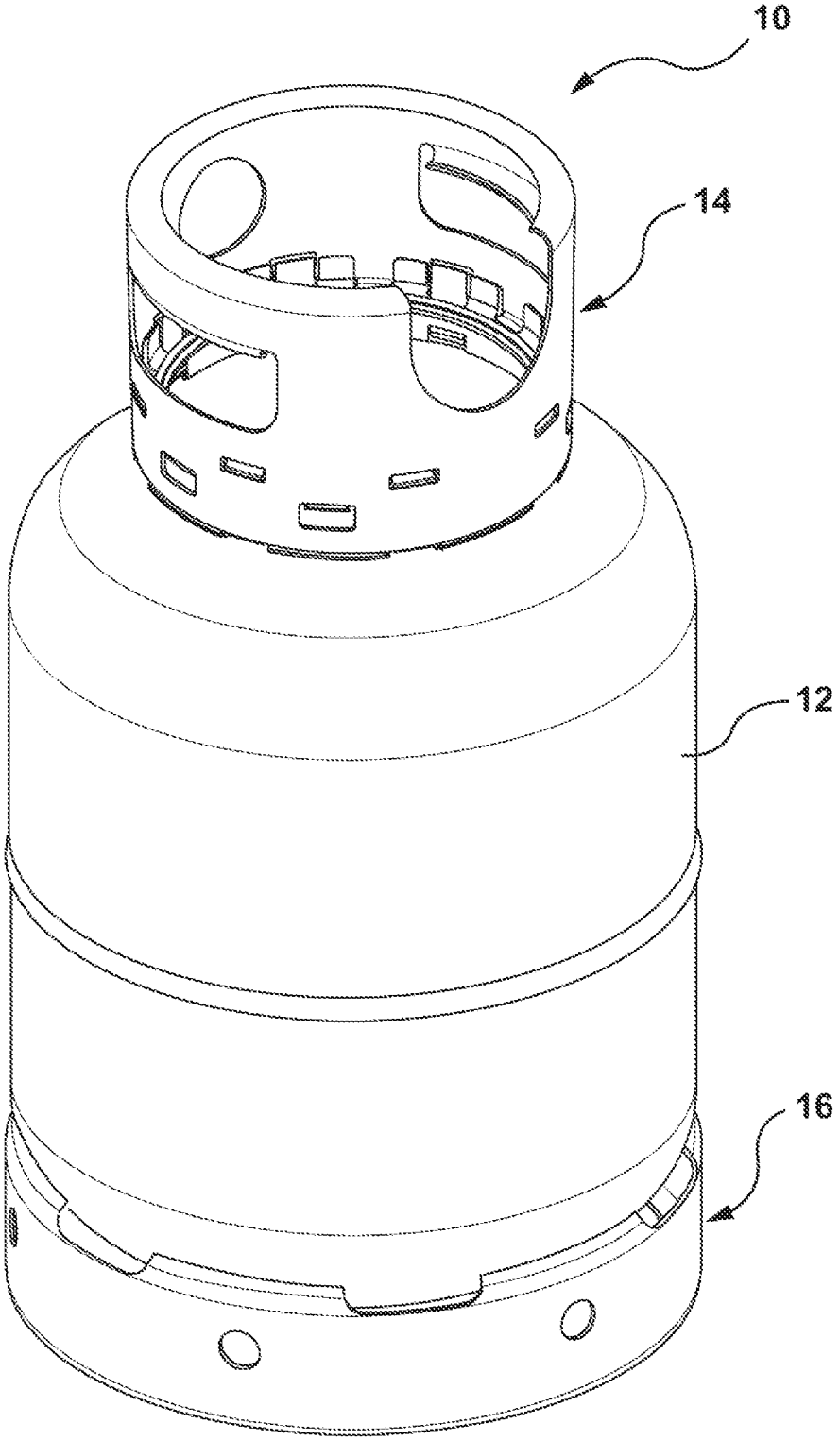
FIG. 1 is a front perspective view of a gas cylinder.

Embodiments of the invention relate to methods and systems that relate to a portable gas cylinder. The cylinder has a gas tank having an upper portion having a valve port and a collar surrounding the valve port. The collar has a body, a flange extending radially outwardly from the body, and a plurality of circumferentially spaced openings in the body. The cylinder also has a handle assembly attached to the gas tank. The handle assembly includes a shroud having a plurality of circumferentially spaced body portions, a first plurality of circumferentially spaced deflectable fingers extending downward in a first direction that are each engaged with a respective one of the plurality of circumferentially spaced openings in the collar to attach the shroud to the collar, and a second plurality of circumferentially spaced deflectable fingers extending upward in a second direction. The handle assembly also includes a handle attached to the shroud, the handle having a body that surrounds and abuts the shroud, and a plurality of circumferentially spaced openings extending through the body. The second plurality of circumferentially spaced deflectable fingers are engaged with a respective one of the plurality of circumferentially spaced openings in the handle.

With reference to the drawings, like reference numerals designate identical or corresponding parts throughout the several views. However, the inclusion of like elements in different views does not mean a given embodiment necessarily includes such elements or that all embodiments of the invention include such elements. The examples and figures are illustrative only and not meant to limit the invention, which is measured by the scope and spirit of the claims.

Figure 2:
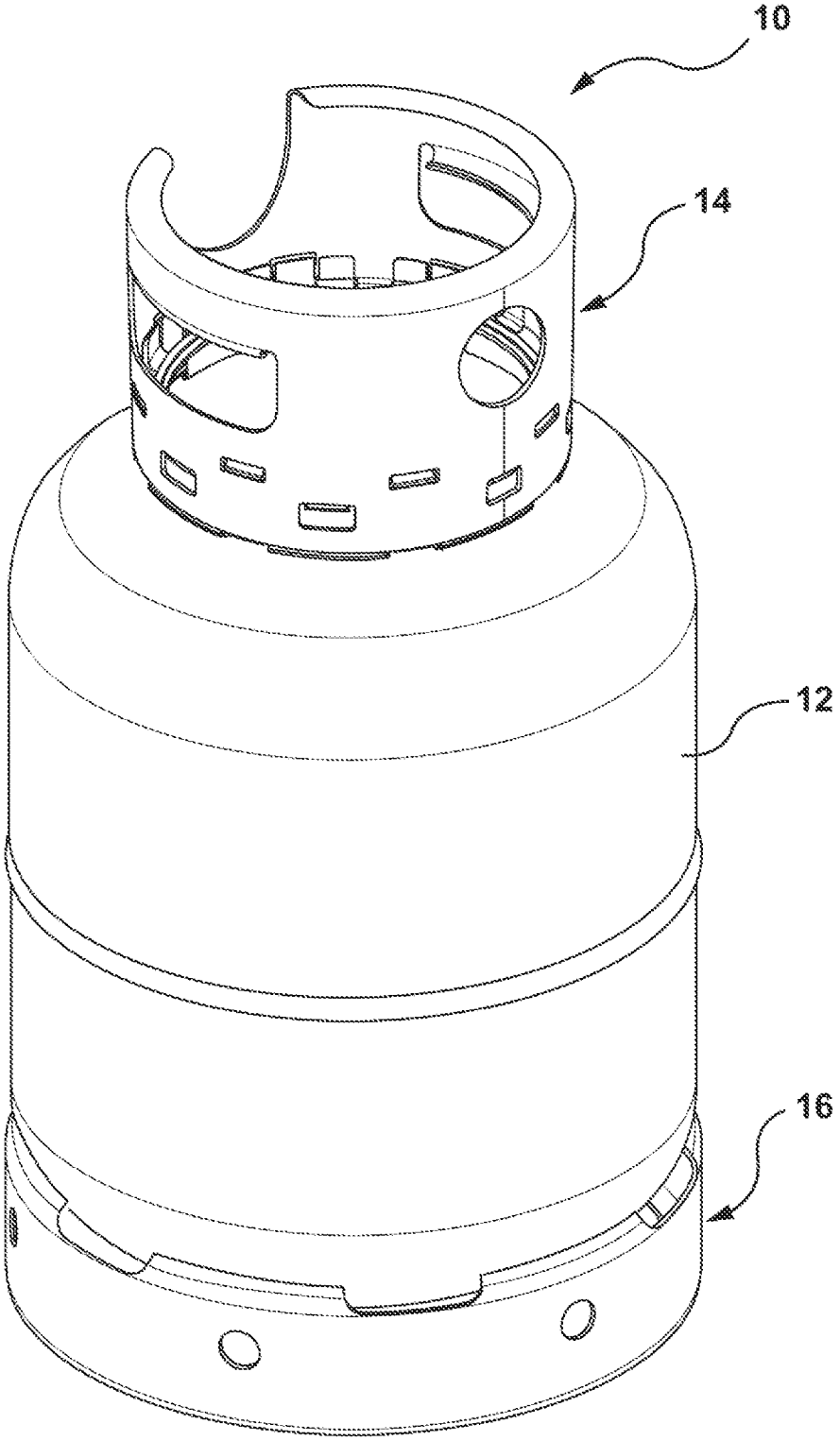
FIG. 2 is a rear perspective view of the gas cylinder.
Figure 3:
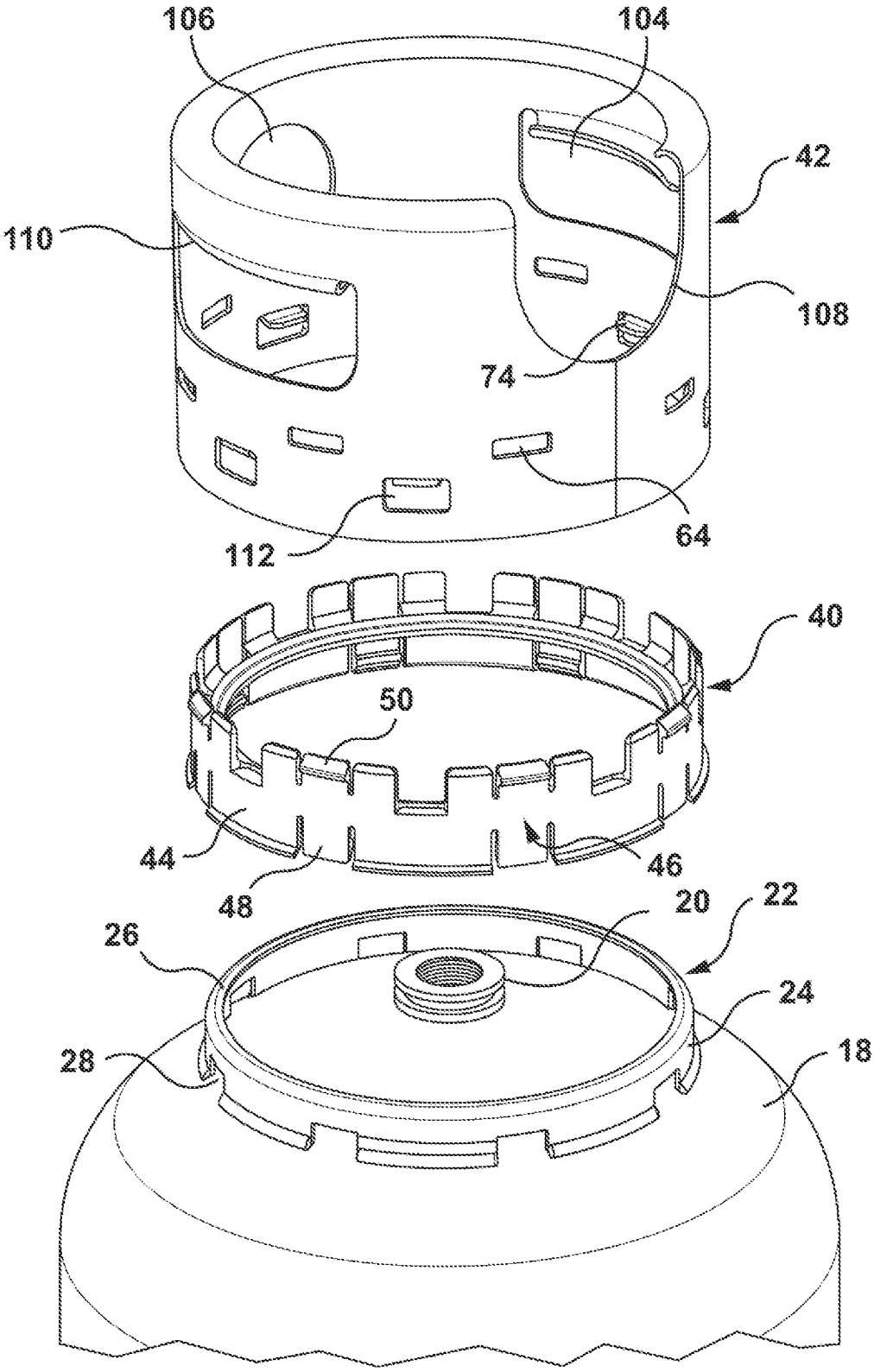
FIG. 3 is an exploded view of the gas cylinder.
Figure 4:
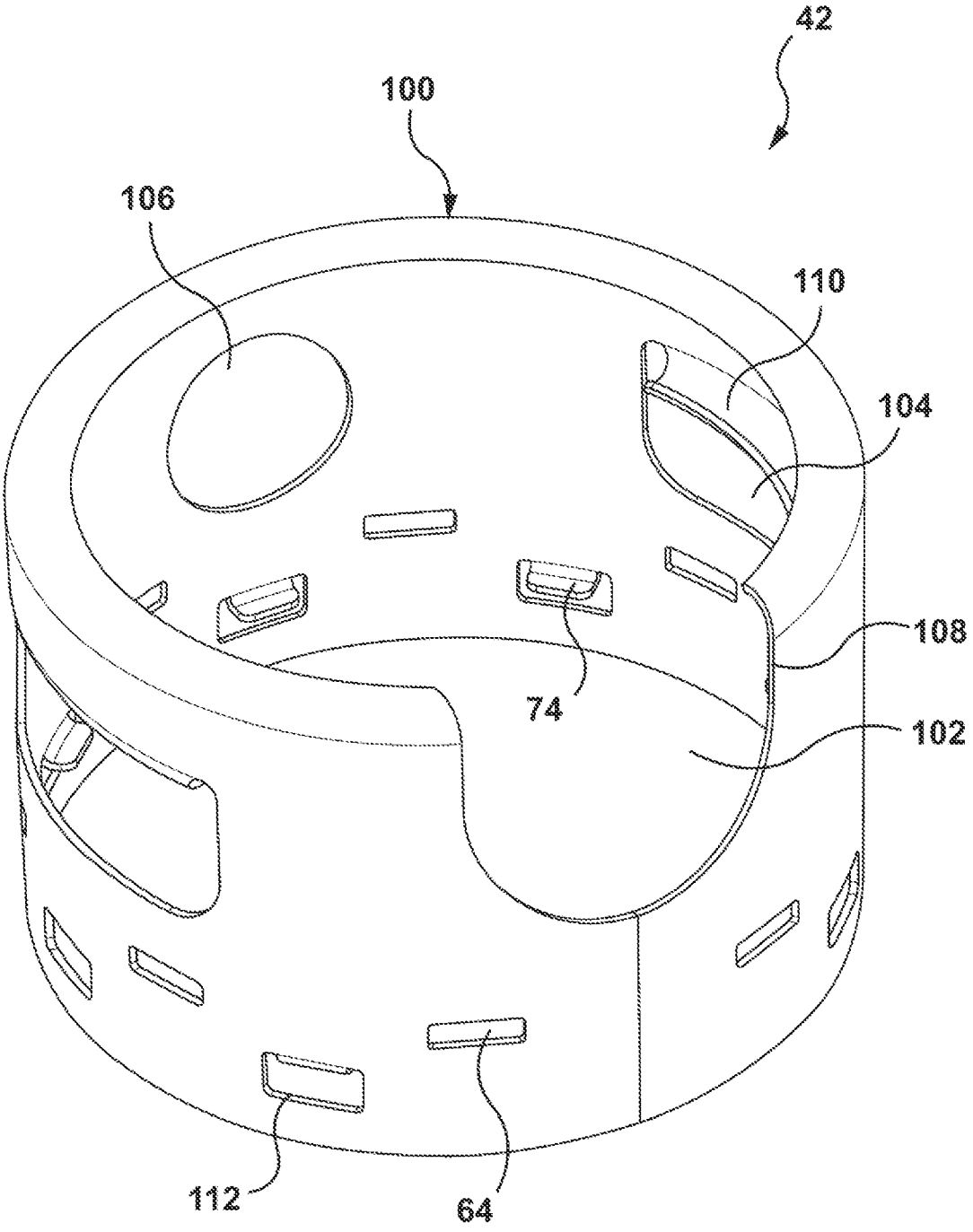
FIG. 4 is a top perspective view of an exemplary handle.
Figure 5:
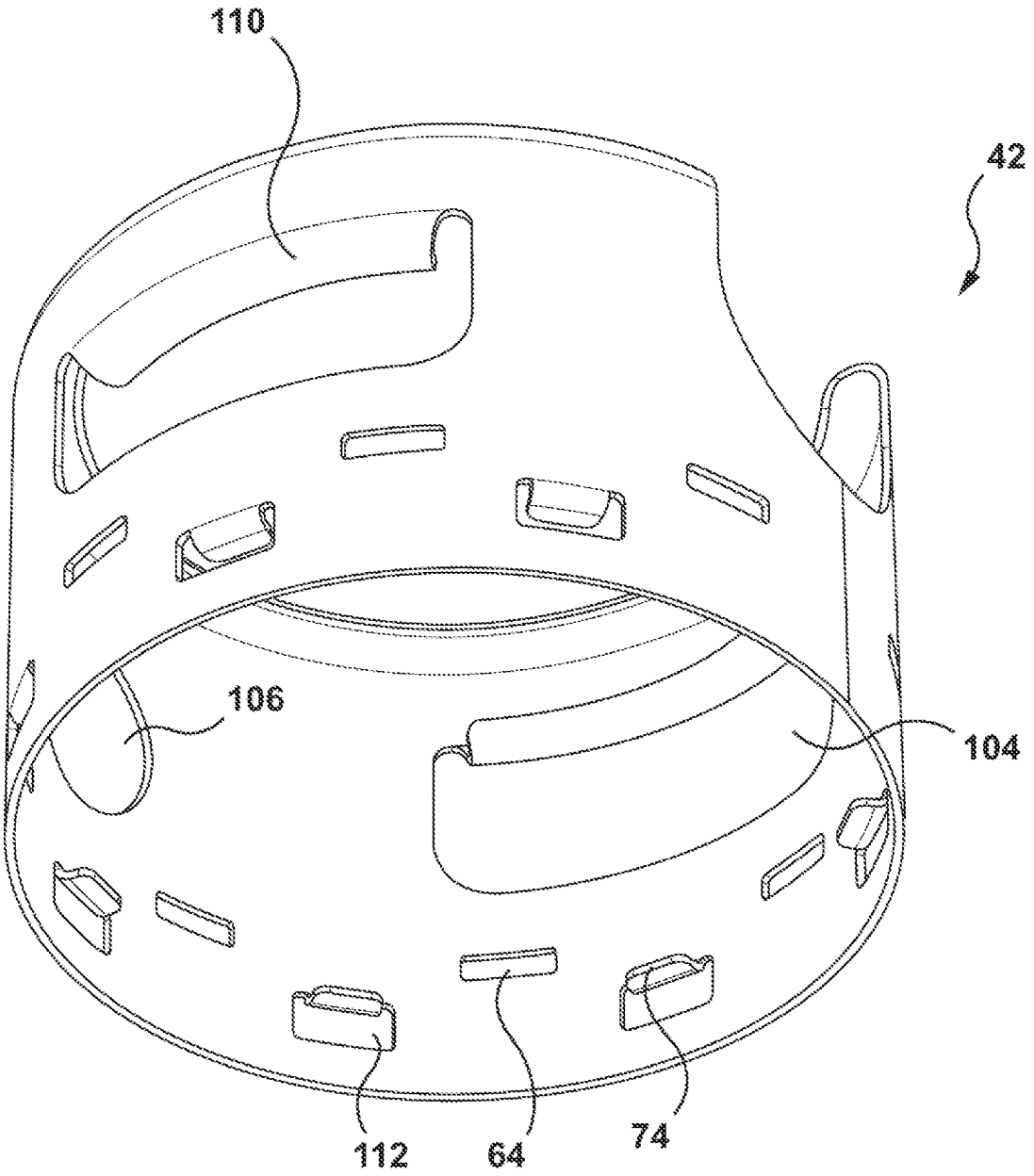
FIG. 5 is bottom perspective view of the handle.
Figure 6:
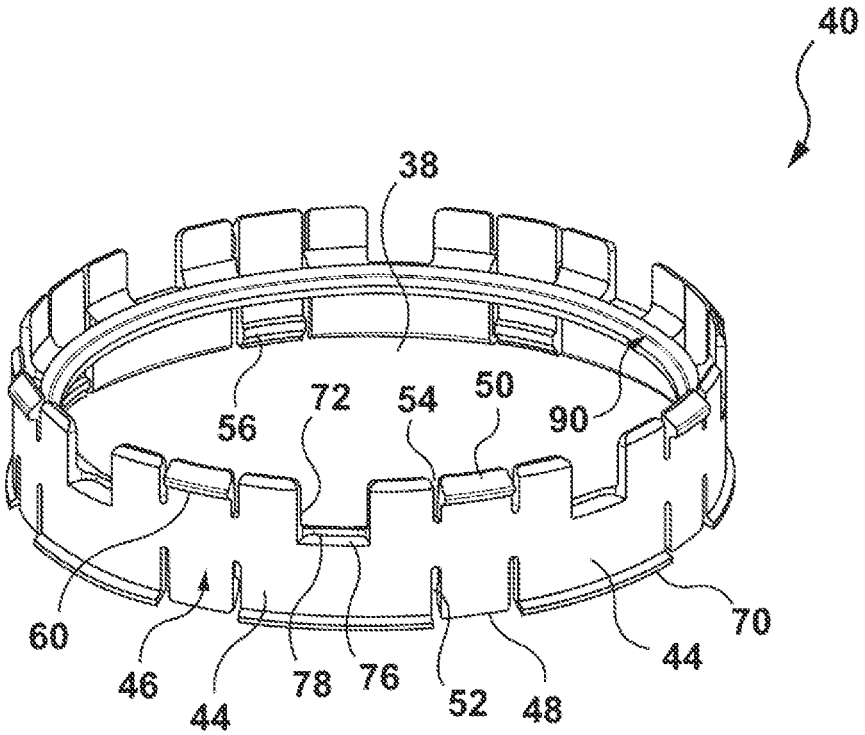
FIG. 6 is a top perspective view of an exemplary shroud.
Figure 7:
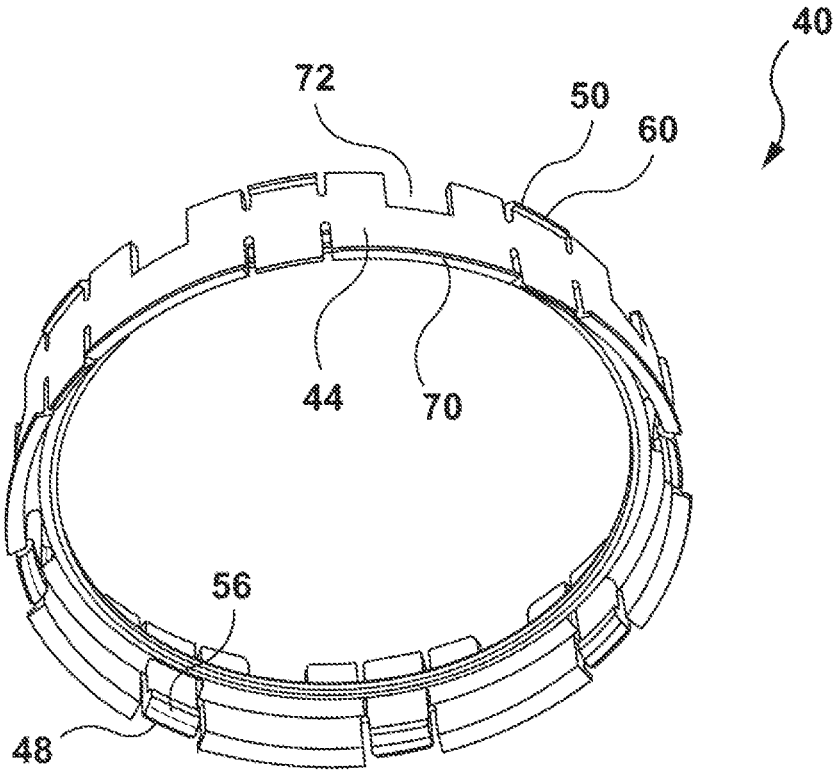
FIG. 7 is a bottom perspective view of the shroud.
Figure 8:
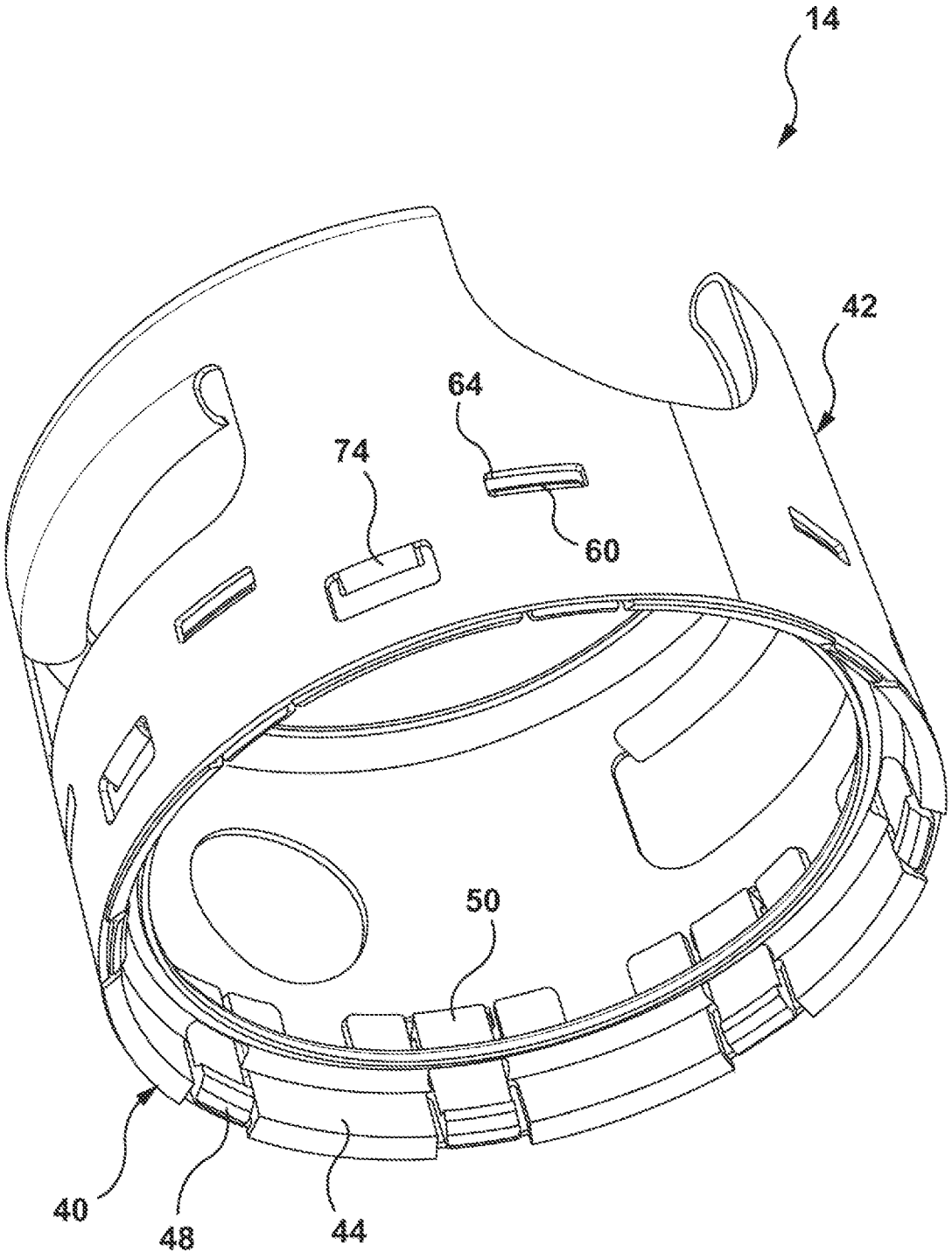
FIG. 8 is a bottom perspective view of the handle and shroud connected together.
Figure 9:
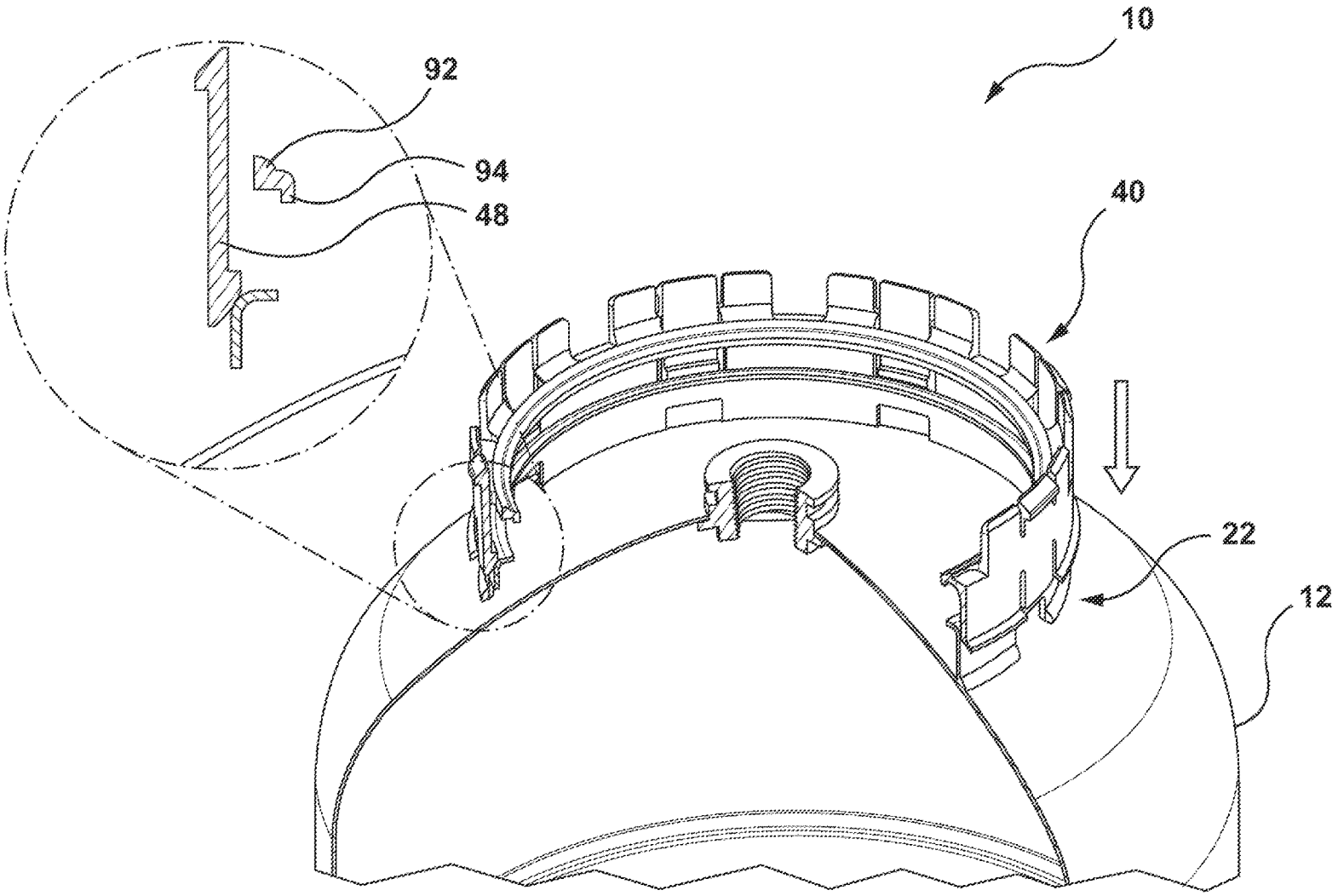
FIG. 9 is perspective view of the shroud being attached to the cylinder.

Turning now to FIGS. 1-3, a portable gas cylinder is shown generally at reference numeral 10. The gas cylinder 10 includes a gas tank 12 configured to store a suitable pressurized gas, a handle assembly 14 attached to a top of the gas tank 12, and a foot assembly 16 attached to a bottom of the gas tank 12. The gas tank 12 may be made of a suitable material, such as metal, and the foot assembly 16 may be made of a suitable material, such as metal or a non-metal material, such as plastic. The gas tank 12 includes an upper portion 18 having a valve port 20 and a mounting collar 22 surrounding the valve port 20.

The mounting collar 22 may be secured to the upper portion 18 in any suitable manner, such as by welding, or may alternatively be integrally formed with the upper portion 18. The mounting collar may be made of a suitable material, such as metal, such as a steel of a grade to allow for welding, corrosion resistance, and to absorb tension on the cylinder without significant deformation. The mounting collar 22 may be painted and finished with the tank 12 to prevent corrosion, and the paint and weld do not need to be removed during requalification thereby preventing the integrity of the wall of the tank 12 from being compromised. The mounting collar 22 has a base 24 attached to the upper portion 18, a flange 26 extending radially inwardly from the base 24, and a plurality of circumferentially spaced openings 28 in the base 24.

Referring additionally to FIGS. 4-8, the handle assembly 14 will be discussed in detail. The handle assembly 14 includes a shroud 40 that attaches to the mounting collar 22 and a handle 42 that attaches to the shroud 40. The handle assembly has the rigidity to maintain ergonomic integrity while having the flexibility to absorb energy. The shroud 40 is substantially cylindrical, with an opening 38 or through passage extending therethrough to surround and abut the mounting collar 22 and to surround the valve port 20. The shroud 40 may be made of a suitable material, such as a polymeric material that is compressible to absorb shocks during drops or impacts. The shroud includes a plurality of body portions 44 and a plurality of connection portions 46. Each connecting portion 46 includes a first plurality of circumferentially spaced fingers 48 extending downward in a first direction towards the tank 12, and a second plurality of circumferentially spaced fingers 50 extending upward in a second direction opposite the first direction away from the tank 12. As shown, each of the first plurality of circumferentially spaced fingers 48 is vertically aligned with one of the second plurality of circumferentially spaced fingers 50, and each connection portion 46 with one of the first and second plurality of circumferentially spaced fingers 48 and 50 is provided between a pair of the body portions 44. As such, the body portions 44 and the connection portions 46 with a set of the fingers 48 and 50 alternate with one another in a circumferential direction forming the circular shroud, which as shown is one piece but could be separate pieces coupled together. It will be appreciated, however, that the shroud 40 may be provided with a minimum number of fingers 48 and 50 to engage with the mounting collar 22 and the handle 42 to secure the handle 42 to the tank 12 and prevent rotation of the handle 42 relative to the tank 12.

Figure 11:
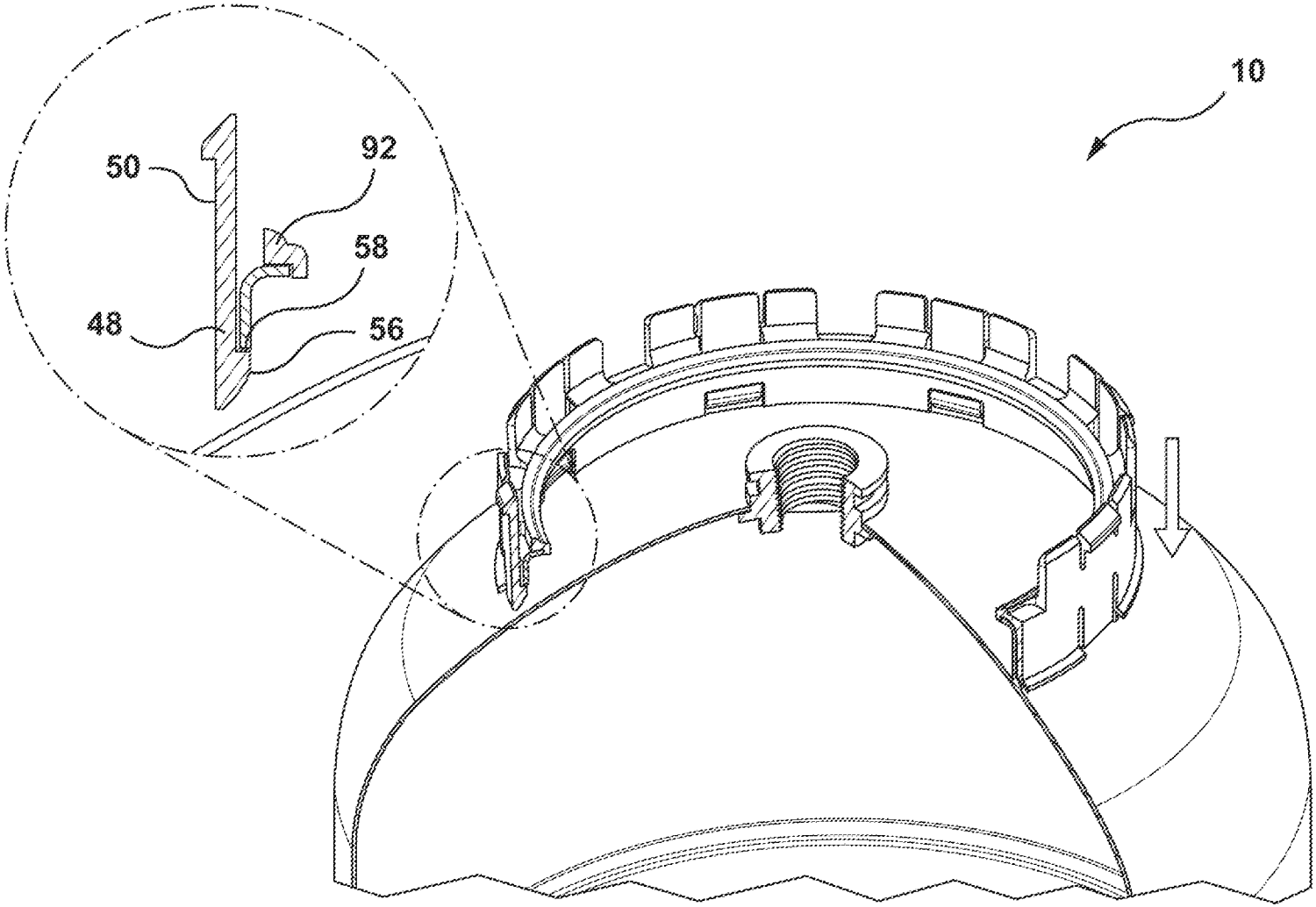
FIG. 11 is still another perspective view of the shroud being attached to the cylinder.
Figure 14:
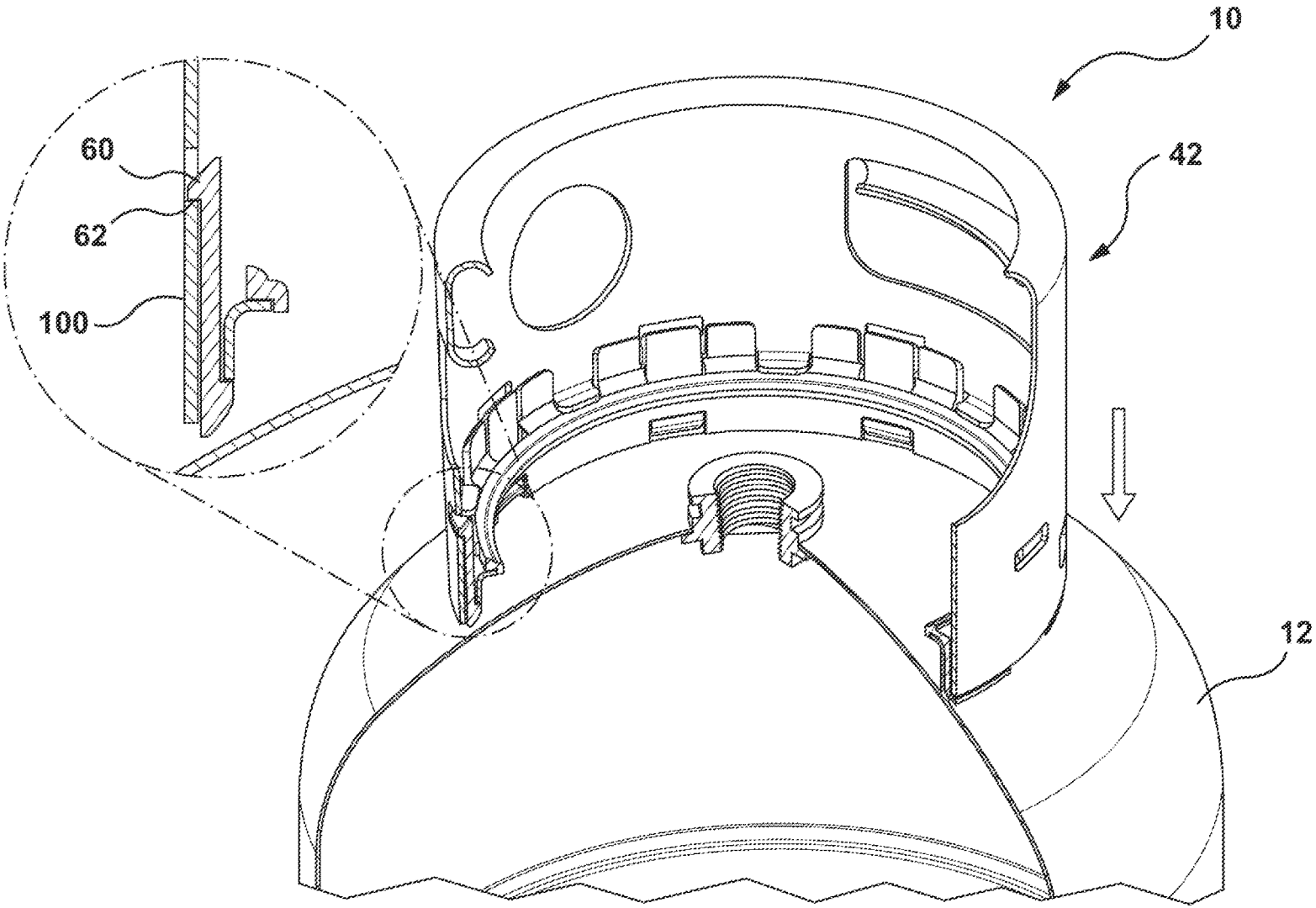
FIG. 14 is still another perspective view of the handle being attached to the shroud.

Each of the first plurality of fingers 48 is spaced from the respective pair of body portions 44 by slots 52 on opposite sides of the fingers 48, and each of the second plurality of fingers 50 is spaced from the respective pair of body portions 44 by slots 54 on opposite sides of the fingers 50. The first and second plurality of circumferentially spaced fingers 48 and 50 are deflectable relative to the body portions 44 for engaging the mounting collar 22 and the handle 42 respectfully. The first plurality of circumferentially spaced fingers 48 are configured to deflect radially outwardly away from the valve port 20 during attachment, and each have a catch 56 extending radially inwardly from the finger 48 that engages a respective surface 58 in the openings 28 as shown in FIG. 11. The second plurality of circumferentially spaced fingers 50 are configured to deflect radially inwardly toward the valve port 20 during attachment of the handle 42, and each have a catch 60 extending radially outwardly from the finger 50 that engages a respective surface 62 in a respective opening 64 in the handle 42 as shown in FIG. 14. The first plurality of circumferentially spaced fingers 48 can be spaced from bottoms of the body portions 44 in the second direction to provide a gap between the upper portion 18 and the fingers 48 to prevent interference during installation.

Each body portion 44 includes a ledge 70 extending radially outwardly at its bottom to provide a surface for a bottom of the handle 42 to abut to space the handle 42 from the upper surface 18 to prevent corrosion. Each body portion 44 also includes a slot 72 at its top configured to be abutted by a tab 74 of the handle 42 as will be described in detail below. A portion of each body portion 44 forming a base 76 of each slot 72 is surrounded by a lip 78 that surrounds sides of the tabs 74. The body portions 44 are substantially U-shaped with a flat bottom such that tops of the body portion are substantially aligned with tops of the second plurality of circumferentially spaced fingers 50. The body portions 44 include lateral portions projecting from either side that are below the slots 54 and above the slots 52 connecting the body portions 44 to the connection portions 46.

The shroud 40 additionally includes a projection 90 extending radially inwardly from the body portions 44 and the first and second plurality of circumferentially spaced fingers 48 and 50. As shown, the projection 90 is a circular projection having a horizontal portion 92 and a vertical portion 94 extending downward from the horizontal portion 92. An underside of the horizontal portion 92 is configured to abut a top of the flange 26 of the mounting collar 22 and an inner side of the vertical portion 94 is configured to abut an inner edge of the flange 26 as shown in FIG. 11.

Referring now to the handle 42 in detail, the handle 42 is substantially cylindrical and may be made of a suitable material, such as a high strength lightweight steel, which may be of a different grade and thickness than the mounting collar 22 and tank 12. In this way, the handle 42 can be deformable during an impact or drop to prevent damage to the tank 12. The handle 42 includes a body 100 and an opening 102 or through passage extending therethrough to surround and abut the shroud 40 and to surround the valve port 20. The body 100 including a plurality of openings 104 and an opening 106 that reduce weight of the handle 42 and provide areas for hanging/holding the cylinder 10, and a cutout 108 that reduces weight and provides an access area for the valve of the cylinder while protecting the valve. For example, the body 100 and openings 104 define grip areas 110 at a top of the handle 42 for a user to grasp the handle 42 to transport the cylinder 10, and the body 100 and openings 106 define an area for receiving a hook or other suitable element for hanging the cylinder 10.

The handle 42 additionally includes the plurality of circumferentially spaced openings 64 that each are configured to receive one of the catches 60 of the second plurality of circumferentially spaced fingers 50, and a plurality of circumferentially spaced openings 112. Projecting radially inwardly from a top of each of the openings 112 is a respective one of the tabs 74 that engage the respective slot 72 in shroud 40. As illustrated, the openings 64 and 112 alternate around the body 102, and the openings 64 are positioned in a direction above the openings 112. The handle may be formed of one piece, which may be shaped and ends held together in a suitable manner, such as by welding.

Turning now to FIGS. 9-17, the attachment of the handle assembly 14 to the gas tank 12 will be described. FIGS. 9-17 show the cylinder 10 with portions cutaway and portions enlarged to illustrate the attachment of the handle assembly 14. The handle assembly 14 is removably attached to the collar 22 to allow the shroud 40 and/or handle 42 to be easily replaced, for example if damaged during a drop, without requiring welds to be removed and redone, which could compromise the integrity of the tank 12. For example, a user could replace the shroud 40 and/or handle 42, without damaging the weld between the collar 22 and the tank 12.

Figure 10:
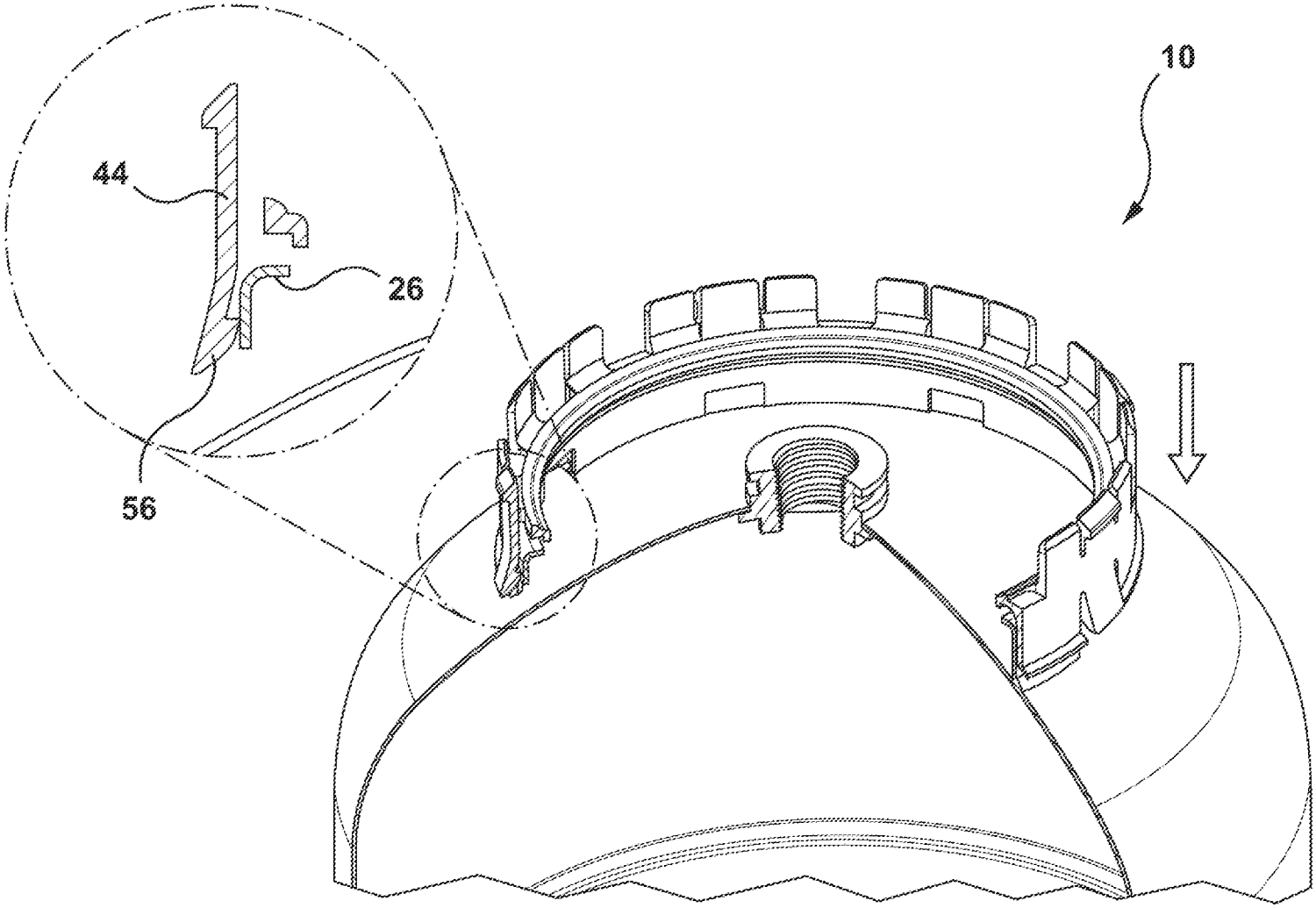
FIG. 10 is another perspective view of the shroud being attached to the cylinder.

Referring initially to FIGS. 9-12, to attach the shroud 40 to the mounting collar 22, the shroud 40 is lowered onto the mounting collar 22 in the first direction. As the shroud 40 is lowered, the plurality of circumferentially spaced fingers 48 are deflected radially outwardly when they contact the base 24 of the mounting collar 22 as shown in FIG. 10. The plurality of circumferentially spaced fingers 48 remain deflected as they move along the base 24 until they reach a respective one of the plurality of openings 28. As the plurality of circumferentially spaced fingers 48 move past the respective surfaces 58, the fingers move radially inward to their initial positions and the catches 56 engage the respective surfaces 58 to connect the shroud 40 to the mounting collar 22. In the engaged position, the horizontal portion 92 of the projection 90 abuts a top of the flange 26 and the vertical portion 94 abuts the inner edge of the flange 26. The interaction between the projection 90 and the flange 26 prevents movement of the shroud 40 relative to the mounting collar 22 in the first direction, and the interaction between the catches 56 and the surfaces 58 prevent movement of the shroud 40 relative to the mounting collar 22 in the second direction. Similarly, the interaction between the sides of the catches 56 and the sides of the respective openings 28 prevent rotation of the shroud 40 relative to the mounting collar 22.

Figure 12:
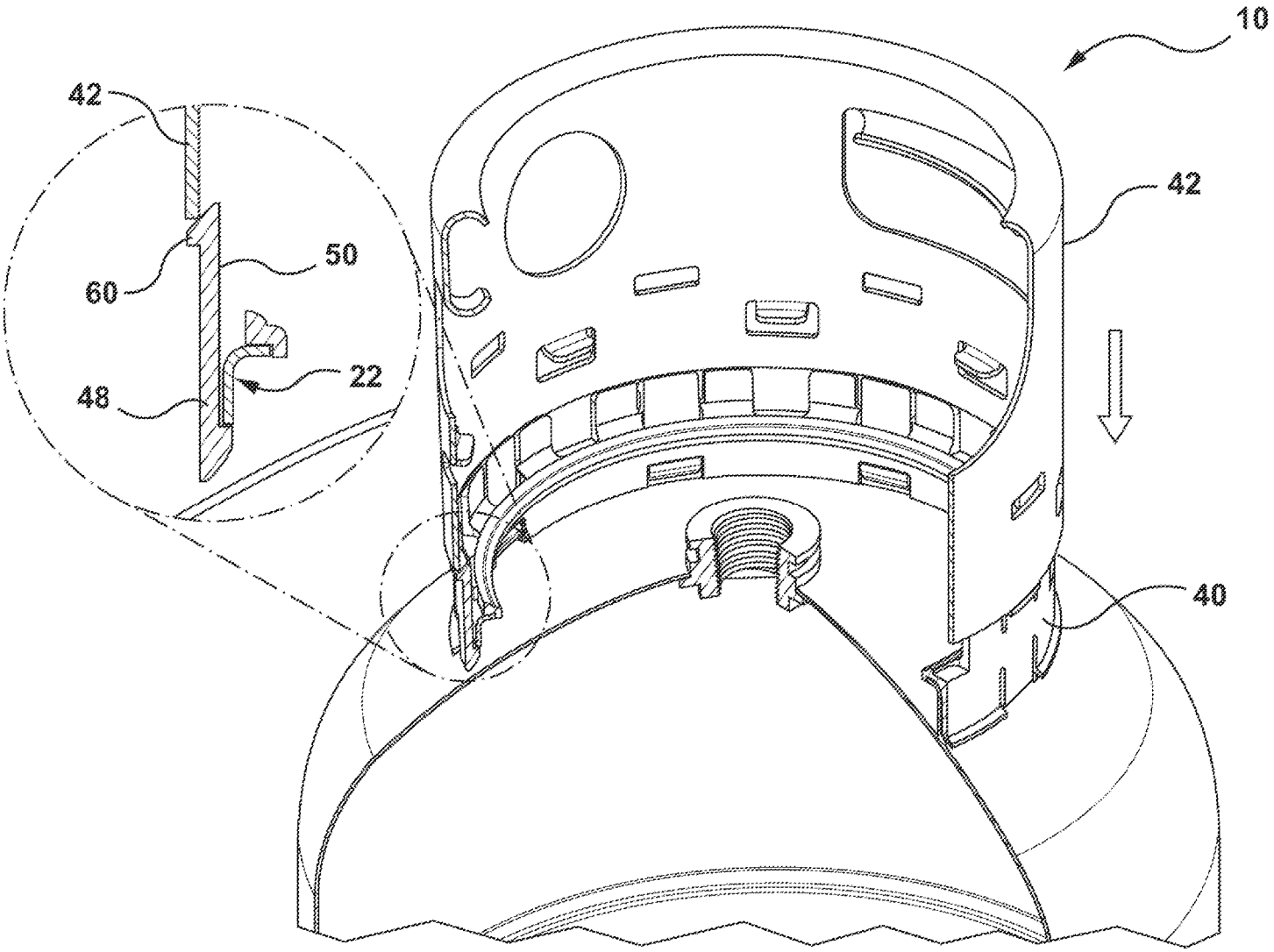
FIG. 12 is a perspective view of the handle being attached to the shroud.
Figure 13:
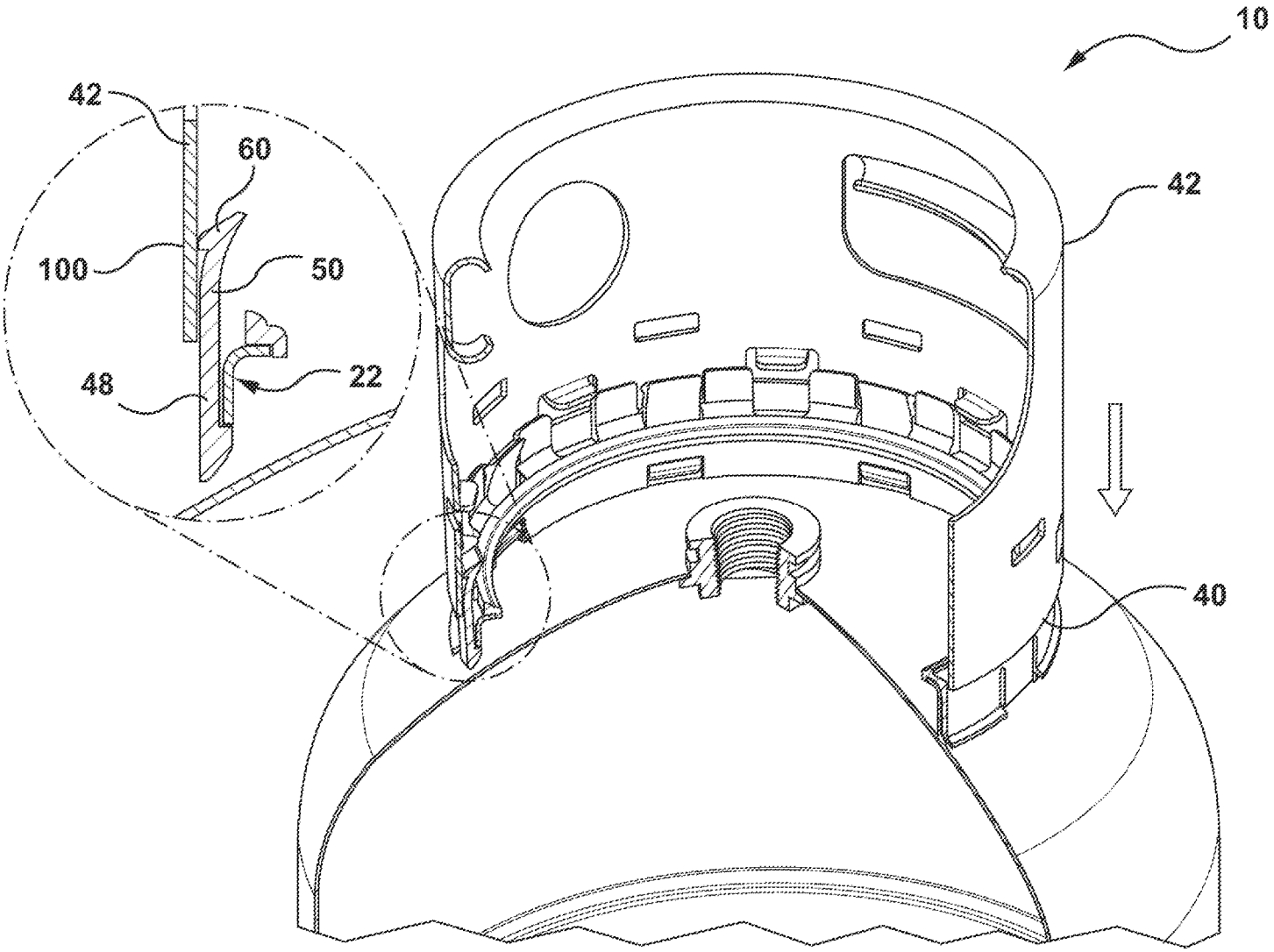
FIG. 13 is another perspective view of the handle being attached to the shroud.

Referring now to FIGS. 12-14, the attachment of the handle 42 to the shroud 40 will be described in detail. To attach the handle 42 to the shroud 40, the handle 42 is lowered onto the shroud 40 in the first direction. As the handle 42 is lowered, the bottom of the handle 42 contacts the catches 60 of the plurality of circumferentially spaced tabs 50 as shown in FIG. 12. As the handle 42 is further lowered, the handle 42 deflects the plurality of circumferentially spaced fingers 50 radially inwardly as shown in FIG. 13, and the plurality of circumferentially spaced fingers 50 remain deflected as they move along the handle 42 until they reach a respective one of the plurality of openings 64. As the plurality of circumferentially spaced fingers 50 move past the respective surfaces 62, the fingers 50 move radially outwardly to their initial positions and the catches 60 engage the respective surfaces 62 to connect the handle 42 to the shroud 40.

Figure 15:
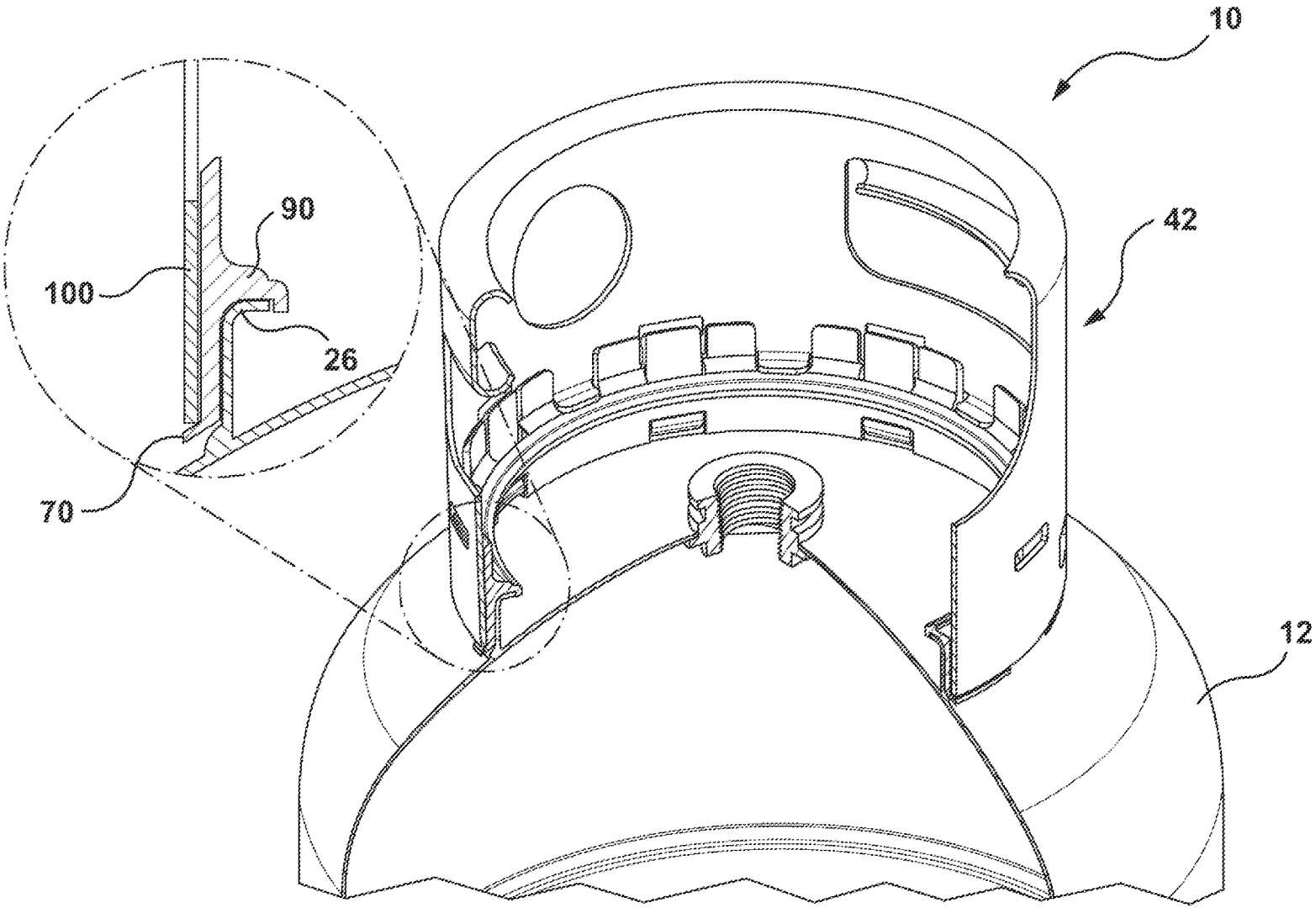
FIG. 15 is a perspective view of the handle attached to the shroud.
Figure 16:
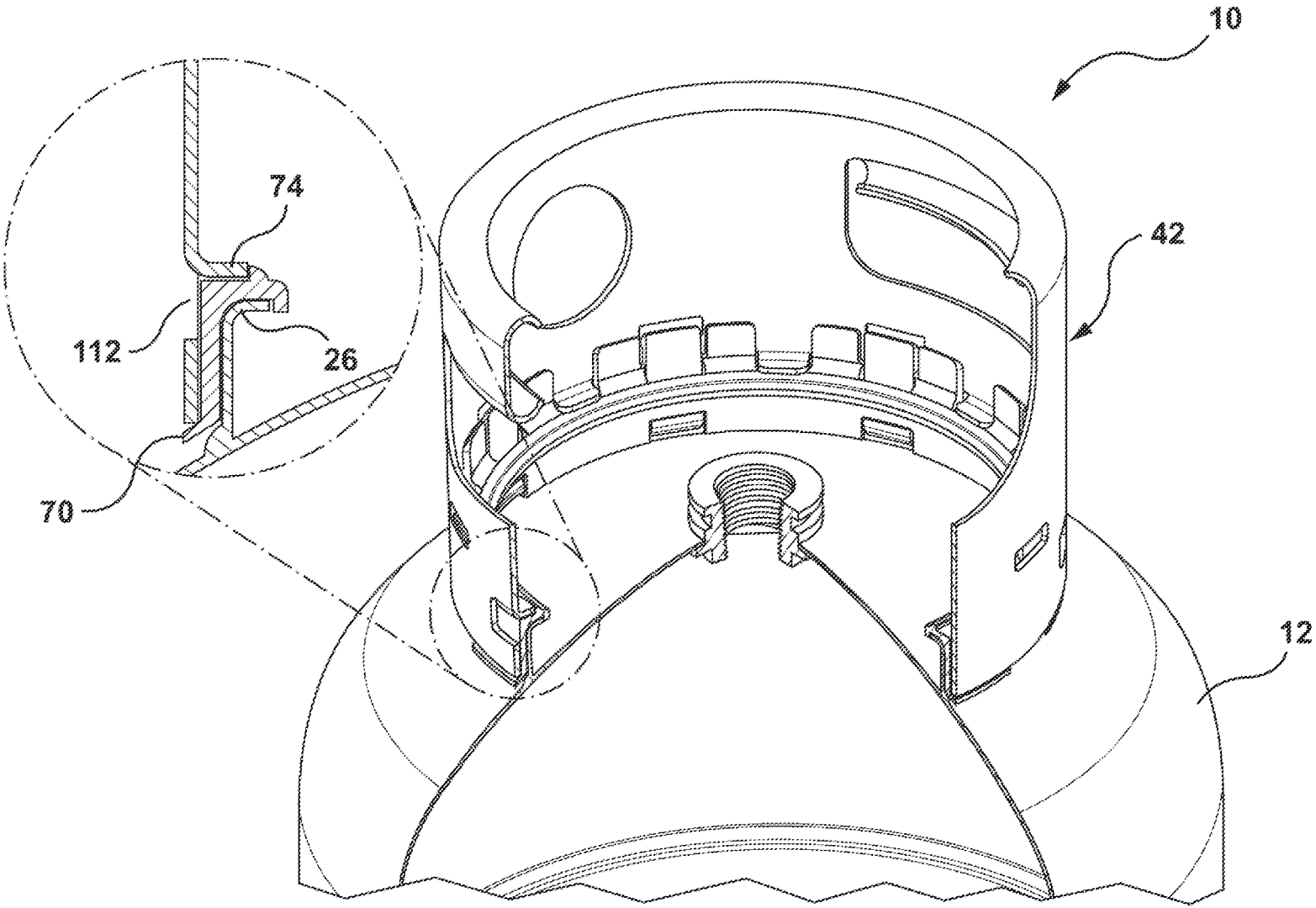
FIG. 16 is another perspective view of the handle attached to the shroud.
Figure 17:
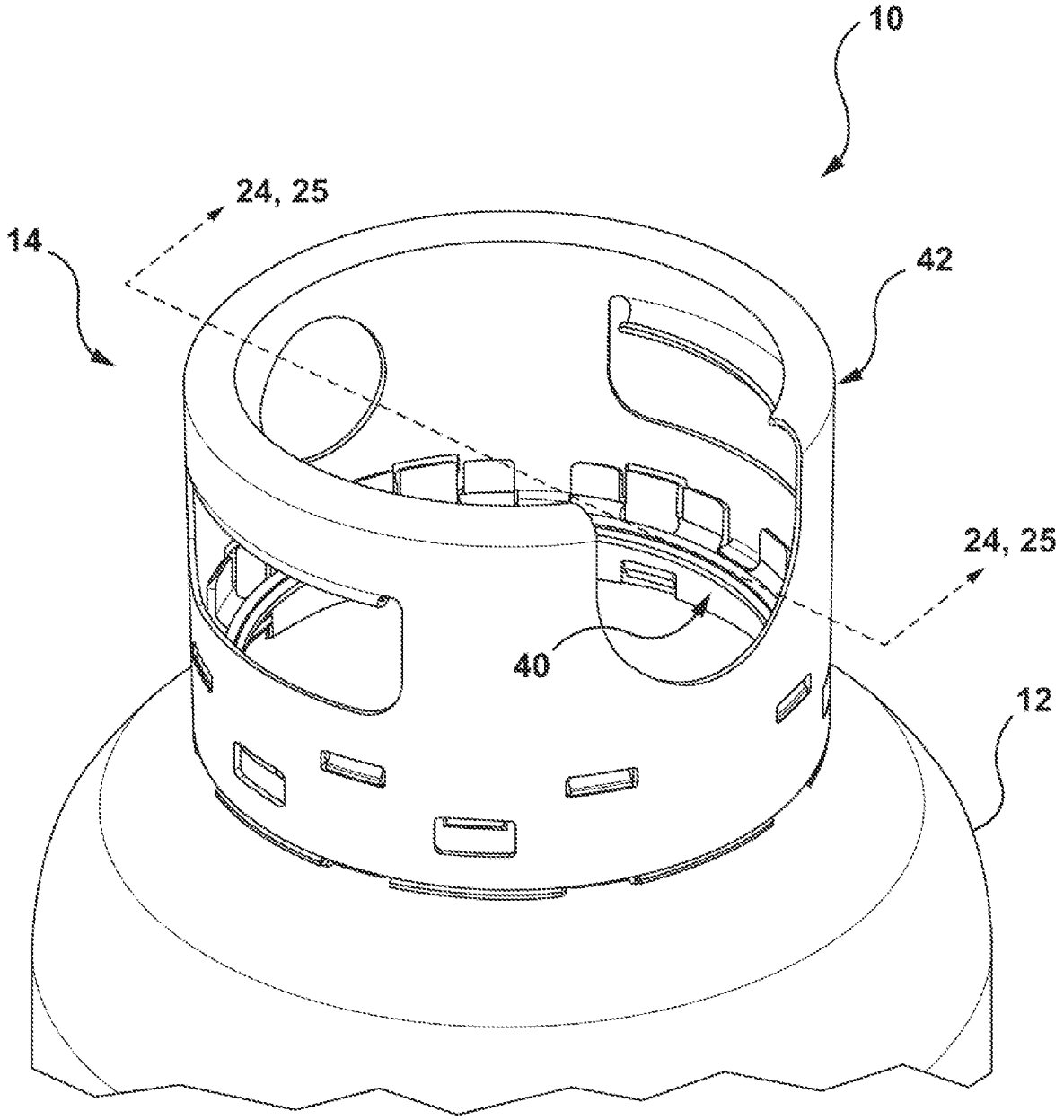
FIG. 17 is still another perspective view of the handle attached to the shroud.

In the engaged position, the plurality of circumferentially spaced tabs 74 of the handle 42 are disposed in the respective slots 72 in the body portions 44 and abut the respective bases 76. The interaction between the tabs 74 and the bases 76 and the interaction between the bottom of the handle 42 and the ledge 70 prevents movement of the handle 42 relative to the shroud 40 in the first direction as shown in FIGS. 15 and 16, and the interaction between the catches 60 and the surfaces 62 prevent movement of the handle 42 relative to the shroud 40 in the second direction. Similarly, the interaction between the sides of the catches 60 and the sides of the respective openings 64 prevent rotation of the handle 42 relative to the shroud 40. Additionally, when a force is applied on the handle 42, the force is not resisted by the plurality of circumferentially spaced tabs 50, but instead is resisted by the plurality of tabs 74 compressing against the respective bases 76. The metallic handle 42 is spaced from the metallic tank 12 and metallic collar 22 by the ledge 70 of the polymeric shroud 40 as shown in FIGS. 15 and 16 to prevent corrosion between the components. The polymeric shroud 40 between the handle 42 and the tank 12 also minimizes deformation of the metal components while providing flexibility to protect the valve.

When the handle 42 is connected to the shroud 40, the body 100 of the handle 42 is radially outwardly spaced from and abutting or in close proximity to the plurality of circumferentially spaced fingers 48 preventing deflection of the fingers 48 thereby preventing disengage of the shroud 40 from the mounting collar 22. To replace or repaint the handle 42, a user deflects the plurality of circumferentially spaced tabs 50 radially inwardly disengaging the catches 60 from the surfaces 62 and the handle 42 is moved in the second direction away from the tank 12. Similarly, to replace the shroud 40 after removal of the handle 42, a user deflects the plurality of circumferentially spaced tabs 48 radially outwardly disengaging the catches 56 from the surfaces 58 and the shroud 40 is moved in the second direction away from the tank 12. By providing a replaceable metal handle 42 and replaceable polymer shroud 40, a user can replace the handle 42 without having specialized equipment and without having to damage the welds securing the mounting collar 22 to the tank 12. The replaceable metal handle also easily allows for multicolor cylinders, for example for customer or gas identification purposes, for example by providing a tank of a first color and a handle of a second color.

Turning now to FIGS. 18-25, an exemplary embodiment of the gas cylinder is shown at 210. The gas cylinder 210 is substantially the same as the above-referenced gas cylinder 10, and consequently the same reference numerals but indexed by 200 are used to denote structures corresponding to similar structures in the gas cylinders. In addition, the foregoing description of the gas cylinder 10 is equally applicable to the gas cylinder 210 except as noted below.

Figure 18:
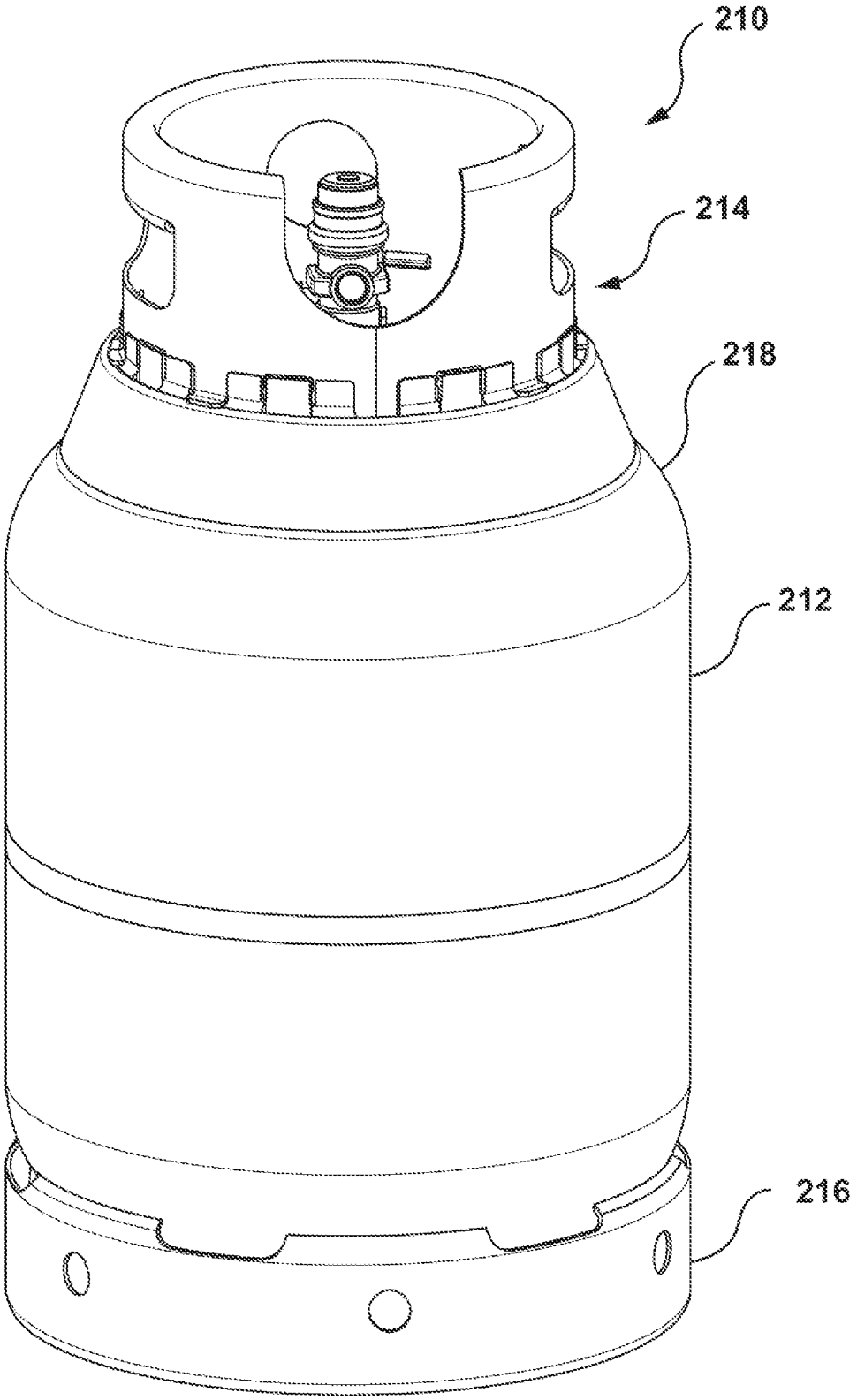
FIG. 18 is a front perspective view of another gas cylinder.
Figure 19:
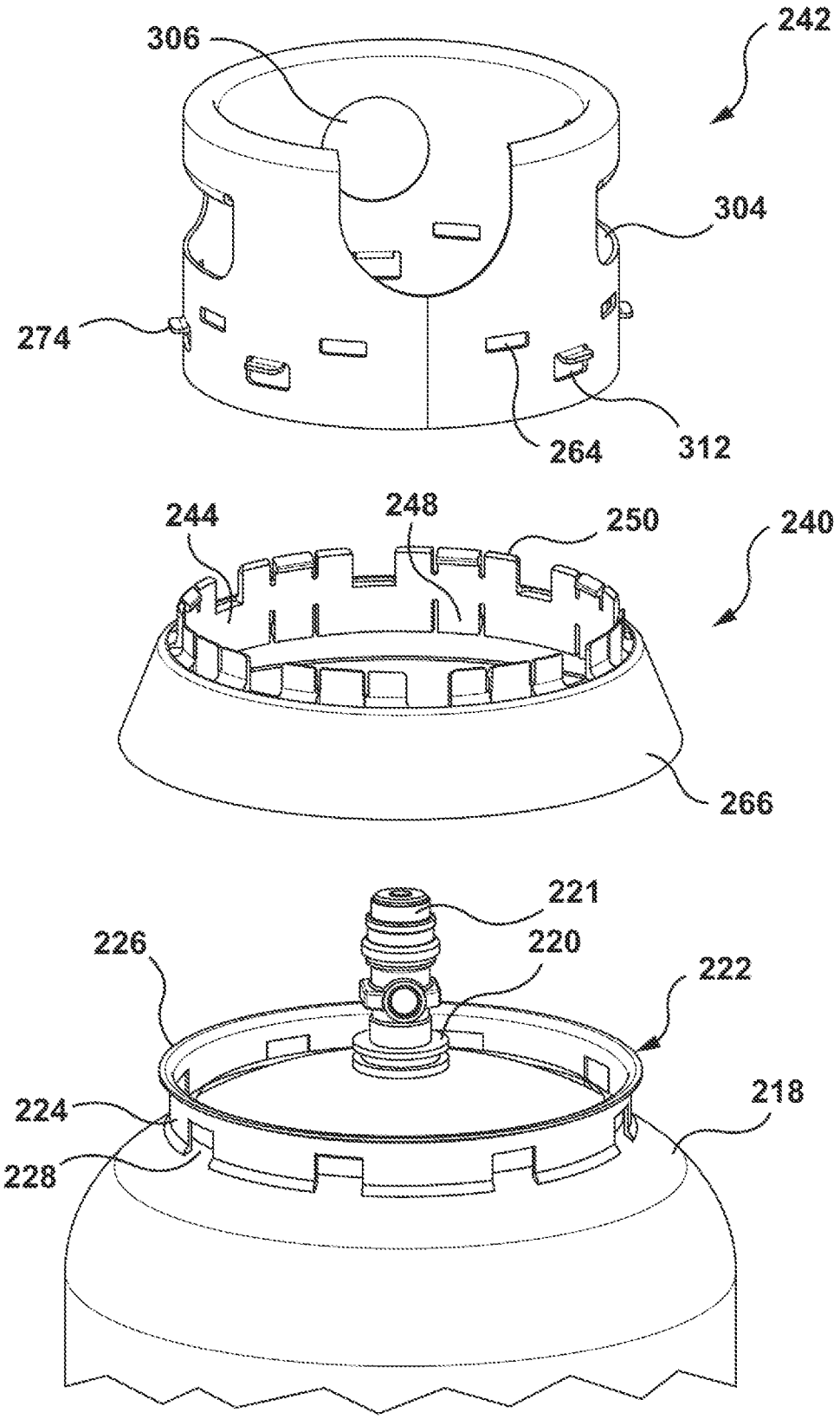
FIG. 19 is an exploded view of the gas cylinder.
Figure 20:
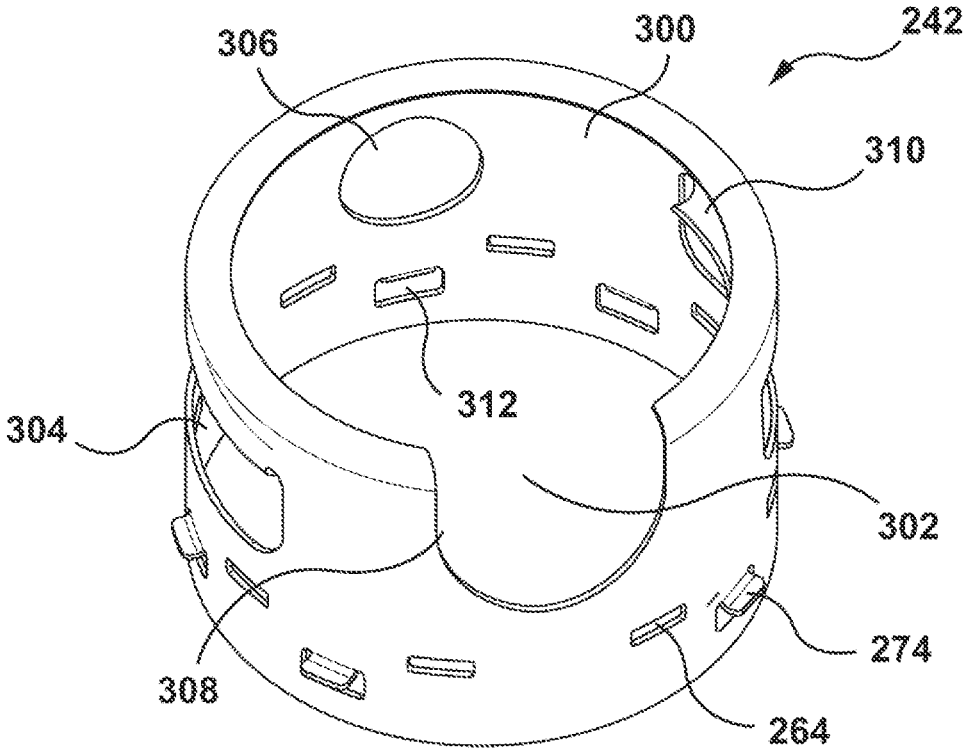
FIG. 20 is a top perspective view of an exemplary handle.
Figure 21:
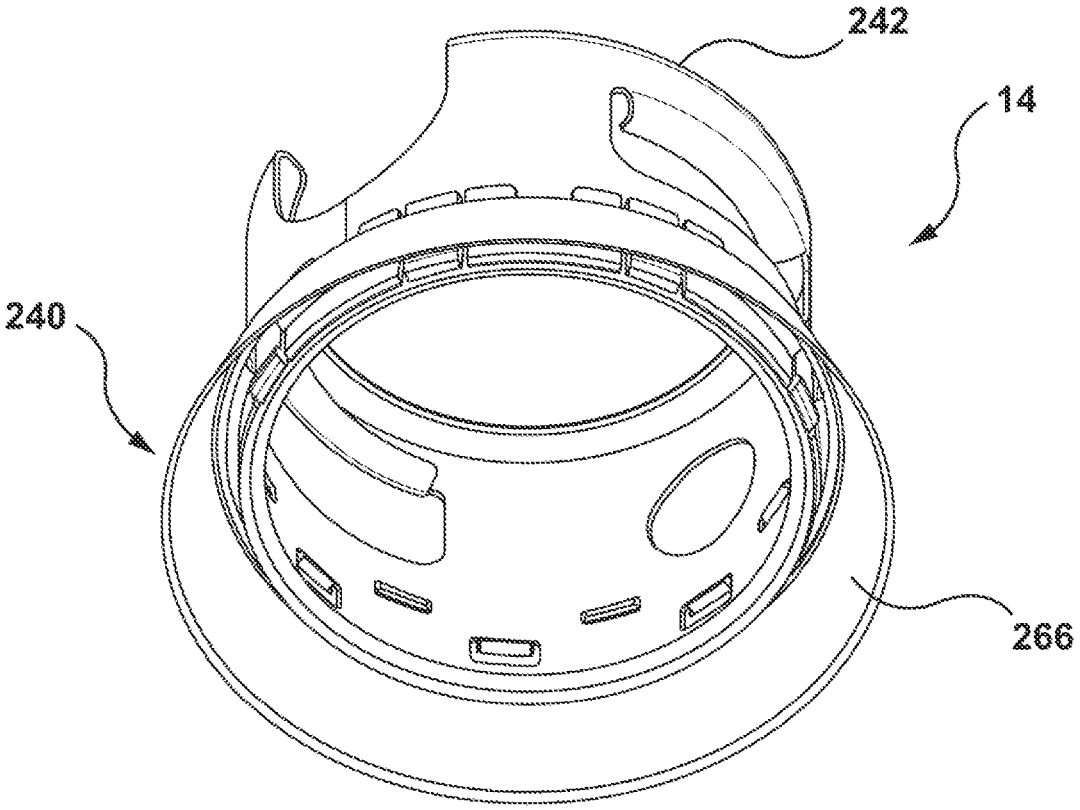
FIG. 21 is a bottom perspective view of the handle and shroud connected together.
Figure 22:
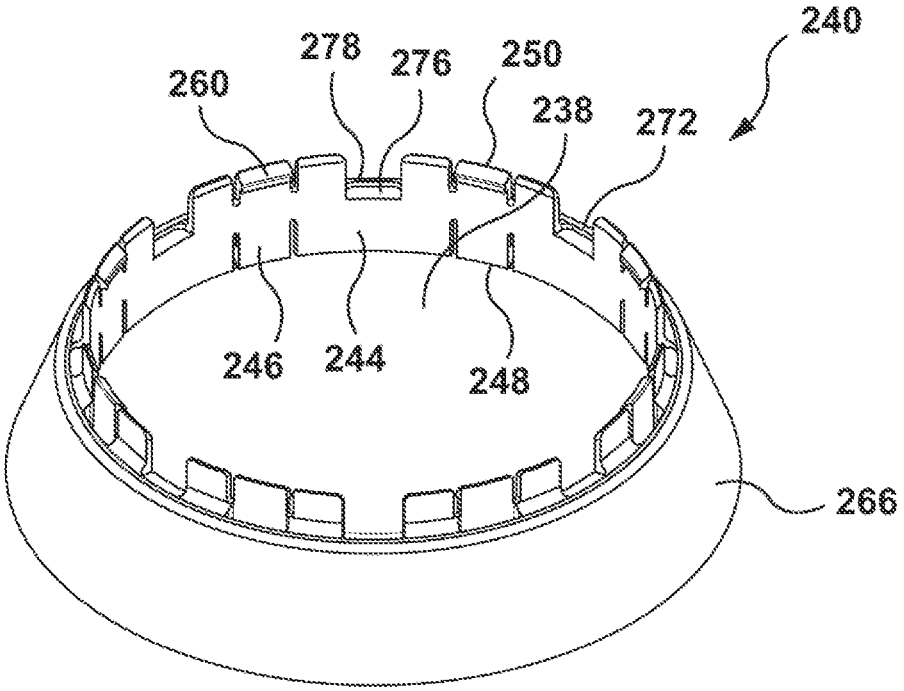
FIG. 22 is a top perspective view of an exemplary shroud.
Figure 23:
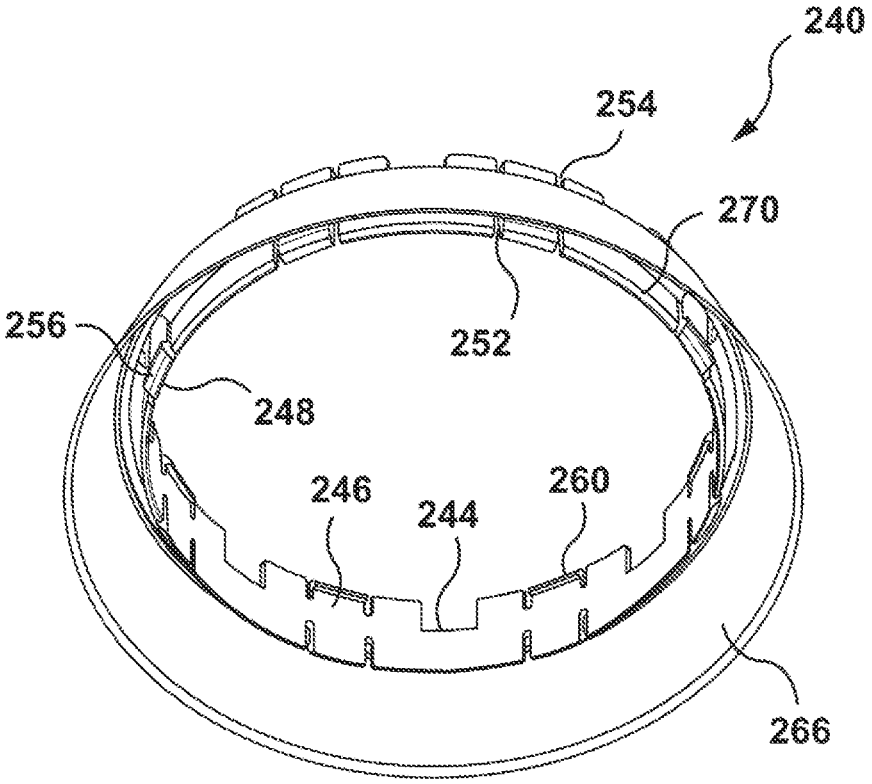
FIG. 23 is a bottom perspective view of the shroud.

Turning initially to FIGS. 18 and 19, the gas cylinder 210 includes a gas tank 212 configured to store a suitable pressurized gas, a handle assembly 214 attached to a top of the gas tank 212, and a foot assembly 216 attached to a bottom of the gas tank 212. The gas tank 212 includes an upper portion 218 having a valve port 220 for receiving valve 221 and a mounting collar 222 surrounding the valve port 220. The mounting collar 222 has a base 224 attached to the upper portion 218, a flange 226 extending radially inwardly from the base 224, and a plurality of circumferentially spaced openings 228 in the base 224.

Referring additionally to FIGS. 20-23, the handle assembly 214 includes a shroud 240 that attaches to the mounting collar 222 and a handle 242 that attaches to the shroud 240. The handle assembly 214 has the rigidity to maintain ergonomic integrity while having the flexibility to absorb energy. The shroud 240 is substantially cylindrical, with an opening 238 or through passage extending therethrough to surround and abut the mounting collar 222 and to surround the valve port 220. The shroud 240 may be made of a suitable material, such as a polymeric material that is compressible to absorb shocks during drops or impacts. The shroud 240 includes a plurality of body portions 244, a plurality of connection portions 246, and a skirt 266 extending outwardly from the body portions 244. Each connecting portion 246 includes a first plurality of circumferentially spaced fingers 248 extending downward in a first direction towards the tank 212, and a second plurality of circumferentially spaced fingers 250 extending upward in a second direction opposite the first direction away from the tank 212. As shown, each of the first plurality of circumferentially spaced fingers 248 is vertically aligned with one of the second plurality of circumferentially spaced fingers 250, and each connection portion 246 with one of the first and second plurality of circumferentially spaced fingers 248 and 250 is provided between a pair of the body portions 244. As such, the body portions 244 and the connection portions 246 with a set of the fingers 248 and 250 alternate with one another in a circumferential direction with the skirt 266 extending outwardly from the body portion 244 forming the circular shroud, which as shown is one piece but could be separate pieces coupled together. It will be appreciated, however, that the shroud 240 may be provided with a minimum number of fingers 248 and 250 to engage with the mounting collar 222 and the handle 242 to secure the handle 242 to the tank 212 and prevent rotation of the handle 242 relative to the tank 212.

Figure 25:
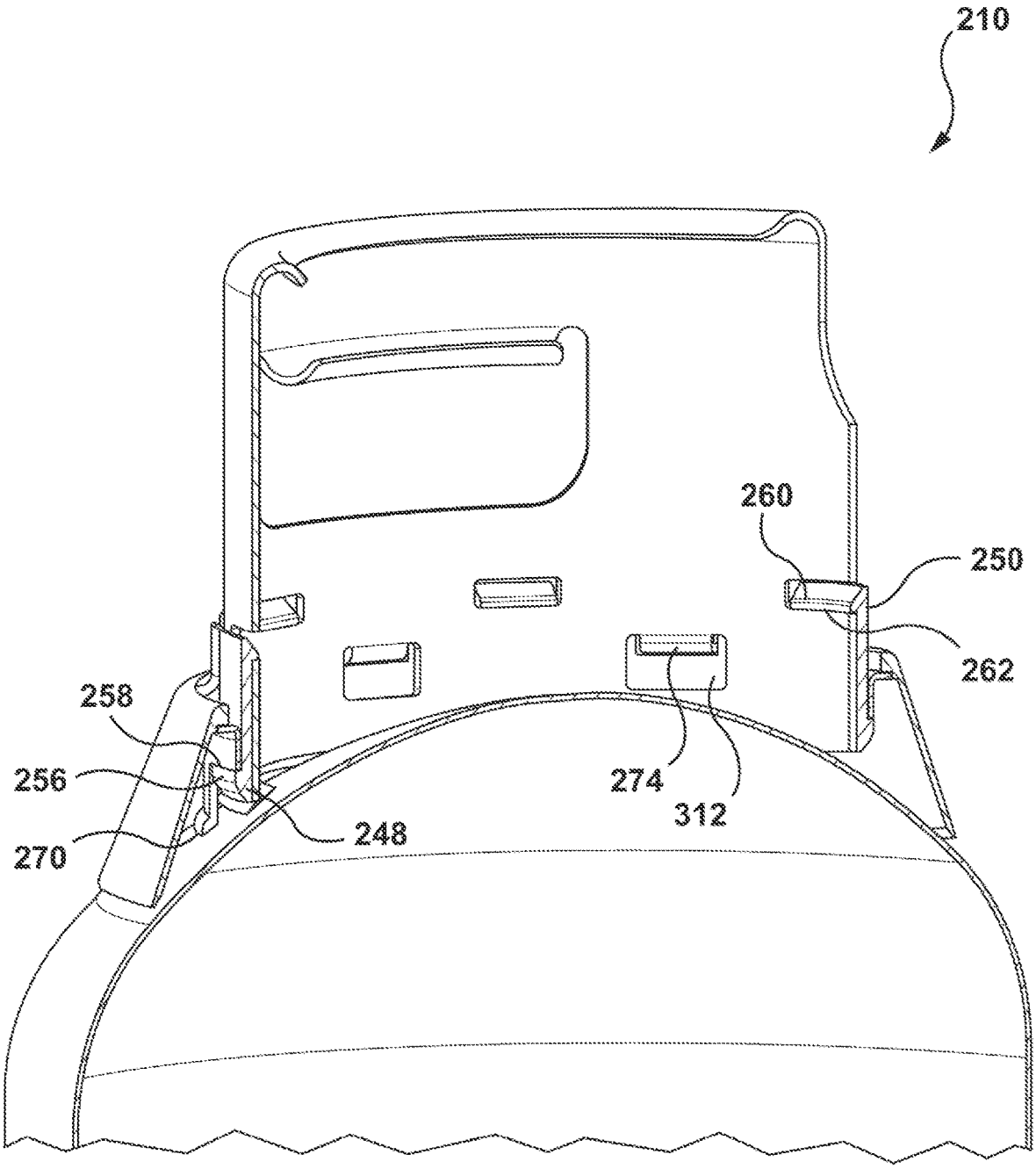
FIG. 25 is another cross-sectional view of the gas cylinder taken along line 25-25 of FIG. 17.

Each of the first plurality of fingers 248 is spaced from the respective pair of body portions 244 by slots 252 on opposite sides of the fingers 248, and each of the second plurality of fingers 250 is spaced from the respective pair of body portions 244 by slots 254 on opposite sides of the fingers 250. The first and second plurality of circumferentially spaced fingers 248 and 250 are deflectable relative to the body portions 244 for engaging the mounting collar 222 and the handle 242 respectfully. The first plurality of circumferentially spaced fingers 248 are configured to deflect radially inwardly toward the valve port 220 during attachment, and each have a catch 256 extending radially outwardly from the finger 248 that engages a respective surface 258 in the openings 228 as shown in FIG. 25. The second plurality of circumferentially spaced fingers 250 are configured to deflect radially outwardly away from the valve port 220 during attachment of the handle 242, and each have a catch 260 extending radially inwardly from the finger 250 that engages a respective surface 262 in a respective opening 264 in the handle 242 as shown in FIG. 25. The first plurality of circumferentially spaced fingers 248 can be spaced from bottoms of the body portions 244 in the second direction to provide a gap between the upper portion 218 and the fingers 248 to prevent interference during installation, for example by ledges 270 that abut the upper surface 218 and that extend radially outwardly from a bottom of each body portion 244.

Each body portion 244 includes a slot 272 at its top configured to be abutted by a tab 274 of the handle 242 as will be described in detail below. A portion of each body portion 244 forming a base 276 of each slot 272 is surrounded by a lip 278 that surrounds sides of the tabs 274. The body portions 244 are substantially U-shaped with a flat bottom such that tops of the body portion are substantially aligned with tops of the second plurality of circumferentially spaced fingers 250. The body portions 244 include lateral portions projecting from either side that are below the slots 254 and above the slots 252 connecting the body portions 244 to the connection portions 246.

Referring now to the handle 242 in detail, the handle 242 is substantially cylindrical and may be made of a suitable material, such as a high strength lightweight steel, which may be of a different grade and thickness than the mounting collar 222 and tank 212. In this way, the handle 242 can be deformable during an impact or drop to prevent damage to the tank 212. The handle 242 includes a body 300 and an opening 302 or through passage extending therethrough to surround and abut the shroud 240 and to surround the valve port 220. The body 300 including a plurality of openings 304 and an opening 306 that reduce weight of the handle 242 and provide areas for hanging/holding the cylinder 210, and a cutout 308 that reduces weight and provides an access area for the valve of the cylinder while protecting the valve. For example, the body 300 and openings 304 define grip areas 310 at a top of the handle 242 for a user to grasp the handle 242 to transport the cylinder 210, and the body 300 and openings 306 define an area for receiving a hook or other suitable element for hanging the cylinder 210.

The handle 242 additionally includes the plurality of circumferentially spaced openings 264 that each are configured to receive one of the catches 260 of the second plurality of circumferentially spaced fingers 250, and a plurality of circumferentially spaced openings 312. Projecting radially outward from a top of each of the openings 312 is a respective one of the tabs 274 that engage the respective slot 272 in shroud 240. As illustrated, the openings 264 and 312 alternate around the body 302, and the openings 264 are positioned in a direction above the openings 312. The handle may be formed of one piece, which may be shaped and ends held together in a suitable manner, such as by welding.

Figure 24:
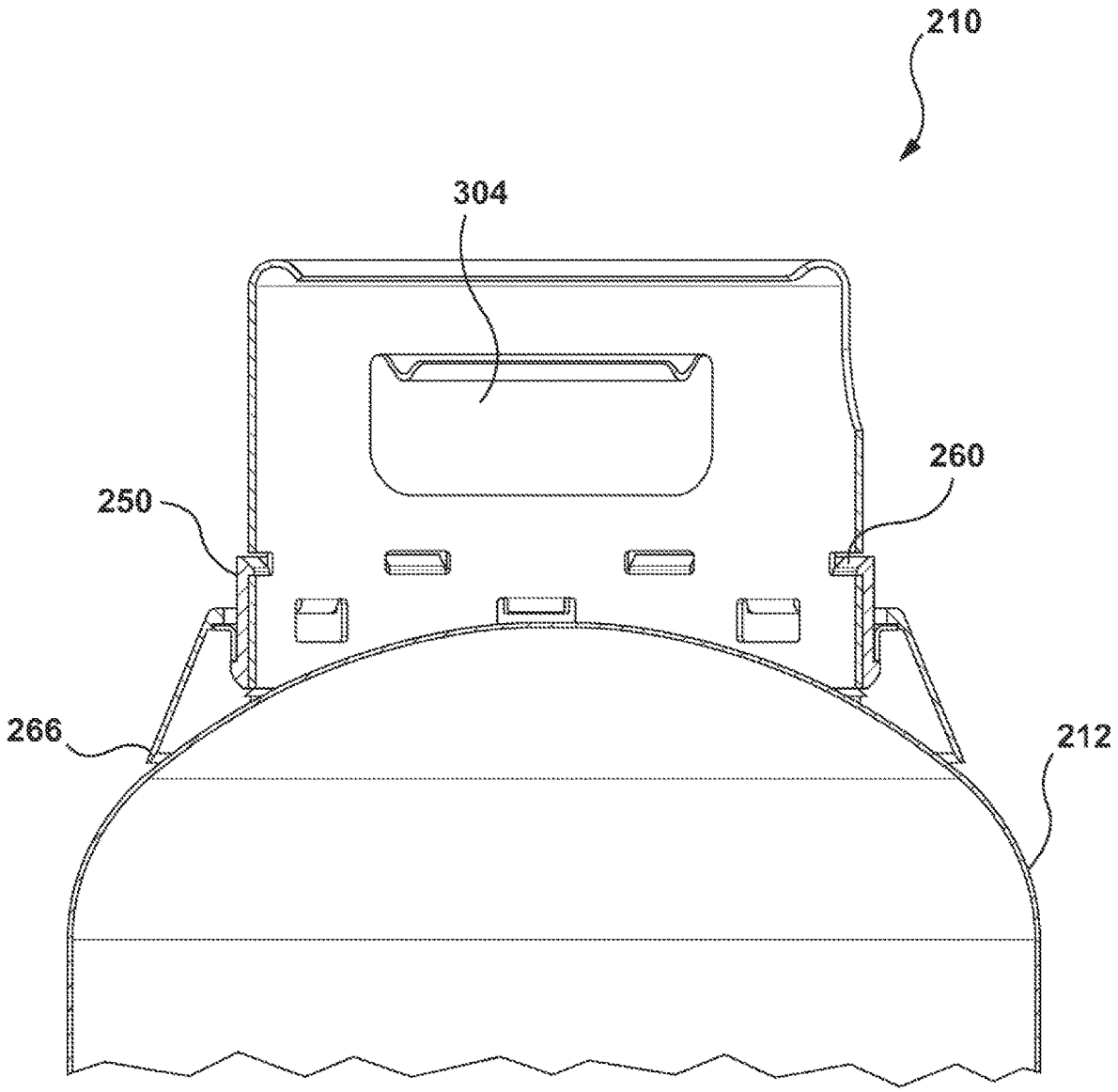
FIG. 24 is a cross-sectional view of the gas cylinder taken along line 24-24 of FIG. 17.

Turning now to FIGS. 24 and 25, the attachment of the handle assembly 214 to the gas tank 212 will be described. The handle assembly 214 is removably attached to the collar 222 to allow the shroud 240 and/or handle 242 to be easily replaced, for example if damaged during a drop, without requiring welds to be removed and redone, which could compromise the integrity of the tank 212. For example, a user could replace the shroud 240 and/or handle 242, without damaging the weld between the collar 222 and the tank 212.

To attach the shroud 240 to the mounting collar 222, the shroud 240 is lowered onto the mounting collar 222 in the first direction. As the shroud 240 is lowered, the plurality of circumferentially spaced fingers 248 are deflected radially inwardly when they contact the base 224 of the mounting collar 222. The plurality of circumferentially spaced fingers 248 remain deflected as they move along the base 224 until they reach a respective one of the plurality of openings 228. As the plurality of circumferentially spaced fingers 248 move past the respective surfaces 258, the fingers move radially outward to their initial positions and the catches 256 engage the respective surfaces 258 to connect the shroud 240 to the mounting collar 222. The interaction between the catches 256 and the surfaces 258 prevent movement of the shroud 240 relative to the mounting collar 222 in the second direction. Similarly, the interaction between the sides of the catches 256 and the sides of the respective openings 228 prevent rotation of the shroud 240 relative to the mounting collar 222.

To attach the handle 242 to the shroud 240, the handle 242 is lowered onto the shroud 240 in the first direction. As the handle 242 is lowered, the bottom of the handle 242 contacts the catches 260 of the plurality of circumferentially spaced tabs 250. As the handle 42 is further lowered within the shroud 240, the handle 242 deflects the plurality of circumferentially spaced fingers 250 radially outwardly, and the plurality of circumferentially spaced fingers 250 remain deflected as they move along the handle 242 until they reach a respective one of the plurality of openings 264. As the plurality of circumferentially spaced fingers 250 move past the respective surfaces 262, the fingers 250 move radially inward to their initial positions and the catches 260 engage the respective surfaces 262 to connect the handle 242 to the shroud 240.

In the engaged position, the plurality of circumferentially spaced tabs 274 of the handle 242 are disposed in the respective slots 272 in the body portions 244 and abut the respective bases 276. The interaction between the tabs 274 and the bases 276 prevents movement of the handle 242 relative to the shroud 240 in the first direction, and the interaction between the catches 260 and the surfaces 262 prevent movement of the handle 242 relative to the shroud 240 in the second direction. Similarly, the interaction between the sides of the catches 260 and the sides of the respective openings 264 prevent rotation of the handle 242 relative to the shroud 240. Additionally, when a force is applied on the handle 242, the force is not resisted by the plurality of circumferentially spaced tabs 250, but instead is resisted by the plurality of tabs 274 compressing against the respective bases 276, which also space the metallic handle 240 from the metallic tank 212 and metallic collar 222 to prevent corrosion between the components. The polymeric shroud 240 between the handle 242 and the tank 212 also minimizes deformation of the metal components while providing flexibility to protect the valve.

When the handle 242 is connected to the shroud 240, the body 300 of the handle 242 is radially inwardly spaced from and abutting or in close proximity to the plurality of circumferentially spaced fingers 248 preventing deflection of the fingers 248 thereby preventing disengage of the shroud 240 from the mounting collar 222. To replace or repaint the handle 242, a user deflects the plurality of circumferentially spaced tabs 250 radially outwardly disengaging the catches 260 from the surfaces 262 and the handle 242 is moved in the second direction away from the tank 212. Similarly, to replace the shroud 240 after removal of the handle 242, a user deflects the plurality of circumferentially spaced tabs 248 radially inwardly disengaging the catches 256 from the surfaces 258 and the shroud 240 is moved in the second direction away from the tank 212.

In the specification and claims, reference will be made to a number of terms that have the following meanings. The singular forms "a", "an" and "the" include plural referents unless the context clearly dictates otherwise. Approximating language, as used herein throughout the specification and claims, may be applied to modify a quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Moreover, unless specifically stated otherwise, a use of the terms "first," "second," etc., do not denote an order or importance, but rather the terms "first," "second," etc., are used to distinguish one element from another.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

This written description uses examples to disclose the subject matter, including the best mode, and also to enable one of ordinary skill in the art to practice the invention, including making and using a devices or systems and performing incorporated methods. The patentable scope of the invention is defined by the claims, and may include other examples that occur to one of ordinary skill in the art. Such other examples are intended to be within the scope of the claims if they have structural elements that do not differentiate from the literal language of the claims, or if they include equivalent structural elements with insubstantial differences from the literal language of the claims.

What is claimed is:

1. A handle assembly for a cylinder comprising:

a shroud configured to attach to a collar of the cylinder to surround a valve port of the cylinder, the shroud having a first plurality of circumferentially spaced deflectable fingers extending downward in a first direction, and a second plurality of circumferentially spaced deflectable fingers extending upward in a second direction; and a handle configured to attach to the shroud, the handle having a body configured to surround and abut the shroud, and a first plurality of circumferentially spaced openings extending through the body, wherein the first plurality of circumferentially spaced deflectable fingers are deflectable to engage respective openings in the collar to attach the shroud to the collar, and the second plurality of circumferentially spaced deflectable fingers are deflectable to engage a respective one of the first plurality of circumferentially spaced openings in the handle, wherein the first plurality of circumferentially spaced deflectable fingers are deflectable radially outwardly to engage the respective openings in the collar, and the second plurality of circumferentially spaced deflectable fingers are deflectable radially inwardly to engage the respective one of the first plurality of circumferentially spaced openings.

2. The handle assembly according to claim 1, wherein the first plurality of circumferentially spaced deflectable fingers each include a catch extending radially inwardly for engaging a surface of the respective opening in the collar, and wherein the second plurality of circumferentially spaced deflectable fingers each include a catch extending radially outwardly for engaging a surface of the respective one of the first plurality of circumferentially spaced openings in the handle.

3. The handle assembly according to claim 1, wherein each of the first plurality of circumferentially spaced fingers is vertically aligned with a respective one of the second plurality of circumferentially spaced fingers.

4. The handle assembly according to claim 3, wherein the shroud additionally includes a plurality of circumferentially spaced body portions, and wherein one of each of the first and second plurality of circumferentially spaced fingers is positioned between a pair of the plurality of circumferentially spaced body portions.

5. The handle assembly according to claim 4, wherein the plurality of circumferentially spaced body portions and the vertically aligned first and second plurality of circumferentially spaced fingers alternate with one another in a circumferential direction.

6. The handle assembly according to claim 4, wherein each body portion includes a ledge extending radially outwardly at a bottom thereof that is configured to be abutted by a bottom of the handle to space the bottom of the handle from the tank.

7. The handle assembly according to claim 1, wherein the handle includes a plurality of circumferentially spaced tabs extending radially inwardly from the body, wherein each tab is configured to abut a respective slot in the shroud.

8. The handle assembly according to claim 7, wherein the handle assembly includes a second plurality of circumferentially spaced openings, and wherein one of the plurality of circumferentially spaced tabs extends from a top of a respective one of the second plurality of circumferentially spaced openings.

9. The handle assembly according to claim 1, wherein the shroud additionally includes a circular projection extending radially inwardly from an inner surface of the shroud that is configured to abut the collar.

10. The handle assembly according to claim 1, wherein the shroud is made of a polymer and the handle is made of metal.

11. A portable gas cylinder comprising:

a gas tank having an upper portion having a valve port and a collar surrounding the valve port, the collar having a plurality of circumferentially spaced openings; and a handle assembly attached to the gas tank, the handle assembly including:

a shroud having a plurality of circumferentially spaced body portions, a first plurality of circumferentially spaced deflectable fingers extending downward in a first direction that are each engaged with a respective one of the plurality of circumferentially spaced openings in the collar to attach the shroud to the collar, and a second plurality of circumferentially spaced deflectable fingers extending upward in a second direction; and a handle attached to the shroud, the handle having a body that surrounds and abuts the shroud, and a plurality of circumferentially spaced openings extending through the body, wherein the second plurality of circumferentially spaced deflectable fingers are engaged with a respective one of the plurality of circumferentially spaced openings in the handle.

12. The portable gas cylinder according to claim 11, wherein the first plurality of circumferentially spaced deflectable fingers are deflectable radially outwardly during attachment to engage the respective one of the plurality of circumferentially spaced openings in the collar, and the second plurality of circumferentially spaced deflectable fingers are deflectable radially inwardly during attachment to engage the respective one of the plurality of circumferentially spaced openings in the handle.

13. The portable gas cylinder according to claim 11, wherein the first plurality of circumferentially spaced deflectable fingers are deflectable radially inwardly during attachment to engage the respective one of the plurality of circumferentially spaced openings in the collar, and the second plurality of circumferentially spaced deflectable fingers are deflectable radially outwardly during attachment to engage the respective one of the plurality of circumferentially spaced openings in the handle.

14. The portable gas cylinder according to claim 11, wherein each of the first plurality of circumferentially spaced fingers is vertically aligned with one of the second plurality of circumferentially spaced fingers.

15. The portable gas cylinder according to claim 11, wherein the first plurality of circumferentially spaced deflectable fingers each include a catch that is engaged with a surface of the respective one of the plurality of circumferentially spaced openings in the collar, and wherein the second plurality of circumferentially spaced deflectable fingers each include a catch that is engaged with a surface of the respective one of the first plurality of circumferentially spaced openings in the handle.

16. The portable gas cylinder according to claim 15, wherein a surface of the body of the handle is in close proximity to a surface of each of the first plurality of circumferentially spaced deflectable fingers to prevent the first plurality of circumferentially spaced deflectable fingers from deflecting.

17. A handle assembly for a cylinder comprising:

a shroud configured to attach to a collar of the cylinder to surround a valve port of the cylinder, the shroud having a first plurality of circumferentially spaced deflectable fingers extending downward in a first direction, and a second plurality of circumferentially spaced deflectable fingers extending upward in a second direction; and a handle configured to attach to the shroud, the handle having a body configured to surround and abut the shroud, and a first plurality of circumferentially spaced openings extending through the body, wherein the first plurality of circumferentially spaced deflectable fingers are deflectable to engage respective openings in the collar to attach the shroud to the collar, and the second plurality of circumferentially spaced deflectable fingers are deflectable to engage a respective one of the first plurality of circumferentially spaced openings in the handle, and wherein the handle includes a plurality of circumferentially spaced tabs extending radially inwardly from the body, wherein each tab is configured to abut a respective slot in the shroud.

18. The handle assembly according to claim 17, wherein the handle assembly includes a second plurality of circumferentially spaced openings, and wherein one of the plurality of circumferentially spaced tabs extends from a top of a respective one of the second plurality of circumferentially spaced openings.

19. The handle assembly according to claim 17, wherein each of the first plurality of circumferentially spaced fingers is vertically aligned with a respective one of the second plurality of circumferentially spaced fingers.

20. The handle assembly according to claim 19, wherein the shroud additionally includes a plurality of circumferentially spaced body portions, and wherein one of each of the first and second plurality of circumferentially spaced fingers is positioned between a pair of the plurality of circumferentially spaced body portions.

* * * * *